US008931138B2

(12) United States Patent
Shimizu

(10) Patent No.: US 8,931,138 B2
(45) Date of Patent: Jan. 13, 2015

(54) MOVEMENT ASSIST DEVICE

(75) Inventor: Yohel Shimizu, Chigasaki (JP)

(73) Assignee: Nifco Inc., Yokohama-shi, Kanagawa (JP)

( * ) Notice: Subject to any disclaimer, the term of this patent is extended or adjusted under 35 U.S.C. 154(b) by 0 days.

(21) Appl. No.: 13/701,292

(22) PCT Filed: May 20, 2011

(86) PCT No.: PCT/JP2011/061687
§ 371 (c)(1),
(2), (4) Date: Dec. 20, 2012

(87) PCT Pub. No.: WO2011/152232
PCT Pub. Date: Dec. 8, 2011

(65) Prior Publication Data

US 2013/0104339 A1 May 2, 2013

(30) Foreign Application Priority Data

May 31, 2010 (JP) ..... 2010-124143

(51) Int. Cl.
*E05F 1/08* (2006.01)
*E05F 1/16* (2006.01)
(Continued)

(52) U.S. Cl.
CPC ..... *E05F 1/16* (2013.01); *A47B 88/047* (2013.01); *E05F 5/003* (2013.01); *E05Y 2900/20* (2013.01)
USPC ..... 16/72; 16/49; 16/71; 16/82

(58) Field of Classification Search
USPC ..... 16/49, 71, 86 B, 70, 72, 80, 85, DIG. 10, 16/91, 94 R, 102, 106, 107; 49/404, 407, 49/386, 451, 454, 455, 409; 312/322, 312/332.1, 333, 334.44, 334.46, 319.1; 292/262, 266–270, 277, 173, 38, 292/DIG. 46; 160/199, 196.1, 206
See application file for complete search history.

(56) References Cited

U.S. PATENT DOCUMENTS 2,744,779 A * 5/1956 Ellis ..... 292/278
3,630,560 A * 12/1971 Atkins et al. ..... 292/270
(Continued)

FOREIGN PATENT DOCUMENTS

DE 202005012954 U1 * 8/2006
JP 2004-176262 A 6/2004
(Continued)

OTHER PUBLICATIONS

PCT, "International Search Report for PCT/JP2011/061687", Jul. 12, 2011.

*Primary Examiner* — Chuck Mah
(74) *Attorney, Agent, or Firm* — Manabu Kanesaka

(57) ABSTRACT

A movement assist device includes a retraction tool having a case, a latch switched between a standby position which is locked inside the case and a retraction position which releases the locking so as to be capable of sliding, and an urging device; and a striker switching the latch from the standby position to the retraction position, or vise versa. The retraction tool or the striker is provided in a fixed body, or a moving body movably disposed in the fixed body. When the latch is switched from the standby position to the retraction position, a sliding door moves by an urging force. The case includes a striker leading portion notched such that a width of the case becomes thin to a middle of the other end from one end in a longitudinal direction. Also, one portion of the latch is exposed and disposed in the leading portion.

3 Claims, 21 Drawing Sheets

(51) Int. Cl.
*A47B 88/04* (2006.01)
*E05F 5/00* (2006.01)

(56) References Cited

U.S. PATENT DOCUMENTS

| | | | | | |
|---|---|---|---|---|---|
| 4,004,372 | A * | 1/1977 | Beard et al. | 49/404 |
| 4,506,407 | A * | 3/1985 | Downey | 16/48.5 |
| 5,450,651 | A * | 9/1995 | Coleman et al. | 16/82 |
| 5,461,754 | A * | 10/1995 | Tillmann et al. | 16/82 |
| 6,691,465 | B1 * | 2/2004 | Stephan | 49/404 |
| 7,430,832 | B2 * | 10/2008 | Hung | 49/404 |
| 2010/0071154 | A1 * | 3/2010 | Bortoluzzi | 16/85 |
| 2010/0123378 | A1 * | 5/2010 | Chen et al. | 312/333 |
| 2010/0229341 | A1 * | 9/2010 | Tomioka | 16/49 |
| 2011/0023370 | A1 * | 2/2011 | Zimmer et al. | 49/360 |
| 2011/0067313 | A1 * | 3/2011 | Walhorn | 49/360 |
| 2011/0167588 | A1 * | 7/2011 | Chang et al. | 16/71 |
| 2013/0014343 | A1 * | 1/2013 | Tanno et al. | 16/49 |

FOREIGN PATENT DOCUMENTS

| | | | |
|---|---|---|---|
| JP | 2008-144567 | A | 6/2008 |
| JP | 2009-275502 | A | 11/2009 |
| JP | 2009-293323 | A | 12/2009 |
| JP | 2010-090571 | A | 4/2010 |
| JP | 2011074737 | A * | 4/2011 |

* cited by examiner

MOVEMENT ASSIST DEVICE

FIELD OF TECHNOLOGY

The present invention relates to a movement assist device which switches a moving body up to a closed position or an open position, or a housed position or a pulled-out position from a middle of an operation by an urging force. Incidentally, the movement assist device of the subject is also called a slide assist mechanism, a buffer closing device, and the like.

BACKGROUND ART

FIGS. 14(*a*) to 14(*c*) show a buffer closing device disclosed in Patent Document 1. The reference alphabet F represents a crossbar structuring a main body frame which is a fixed body. In the crossbar F, there is provided a transverse groove. A sliding door D which is the moving body includes a door neck D1 which fits into the transverse groove thereof. Then, in the structure, there is provided a retraction tool (a device main body) 1 in the sliding door D, and a striker (an engagement member) 2 is attached to the transverse groove of the crossbar F. The striker 2 is attached inside the transverse groove of the crossbar F, and an engagement protrusion 2*a* protrudes downwardly. On the other hand, the retraction tool 1 includes a case 3; a latch (an engagement member) 5 disposed inside the case 3, and switched between a stand-by position (see FIG. 14(*b*)) locked to be incapable of sliding, and a retraction position (see FIG. 14(*c*)) in which the locking is released so as to be capable of sliding; and a coil spring 40 as a closing mechanism B. The reference numeral 12 represents a first cylinder, and the first cylinder 12 drives a first piston 11. The reference numeral 6 represents a piston rod, and the piston rod 6 pivotally supports the latch 5. The case 3 includes a concave groove 3*a* whose upper side is open up to a middle from one end; and a first guide groove 25 and a second guide groove 26, which extend backward and forward. The concave groove 3*a* allows the engagement protrusion 2*a* to come in and out of the case. The guide grooves 25 and 26 guide sliding of the latch 5. The guide groove 25 includes a folded portion 25*a* wherein one end side of the case is folded downwardly, and which locks the latch 5 to be incapable of sliding. Then, the case 3 forms one portion of the door neck which continues to the door neck D1 in an attachment state wherein a lower side is provided to be buried in a concave-like portion provided in an upper end face of the sliding door D.

In the above-mentioned buffer closing device, as shown in FIG. 14(*b*), when the latch 5 is in the standby position, an engagement axis 21 provided in the latch 5 is locked in the folded portion 25*a*, and a position of the latch 5 is controlled although the latch 5 is receiving an urging force accumulated in the coil spring 40. Then, from a state of FIG. 14(*b*), when the sliding door D is moved in a left direction further, the engagement protrusion 2*a* hits against a corresponding inner face of the latch 5, and the latch 5 is rotated by the force thereof so as to be switched to the retraction position of FIG. 14(*c*) from the standby position. In the retraction position, in a state wherein the latch 5 has restrained the engagement protrusion 2*a*, the engagement axis 21 is unlocked from the folded portion 25*a* so as to enter into a horizontal groove portion of the guide groove 25. Consequently, the latch 5 is slid by the urging force accumulated in the coil spring 40 so as to automatically switch the sliding door D to the closed position. Also, in an opening operation of the sliding door D from the closed position, when the latch 5 is slid to a right side of the figure, accompanied by that, as shown in FIG. 14(*b*), the urging force is accumulated. Furthermore, when the sliding door is moved in an open direction, the latch 5 is switched to the standby position again.

FIG. 15(*a*) and FIG. 15(*b*) show the movement assist device (the slide assist mechanism) disclosed in Patent Document 2. In the structure, a main body frame which is a fixed body movably holds a sliding door which is a moving body, and in the sliding door, a striker (a projecting body) 9 is provided to protrude on an upper end face. A retraction tool (a retraction unit) comprises a case 1 attached to the main body frame; sliders 2A and 2B slidably disposed in the case 1; latches 5 pivotally supported to be capable of rotating through a shaft 8 relative to each slider; and urging devices 3. Here, the sliders 2A and 2B include convex portions 22 on upper and lower faces. Each convex portion 22 fits into guide grooves 12*b* and 16*b* provided on upper and lower faces of the case 1, and is slid while being guided by the upper and lower guide devices. Each latch 5 includes protrusions 52 on upper and lower faces. Each protrusion 52 fits into guide grooves 14 and 19 provided on the upper and lower faces of the case 1, and is slid while being guided by the upper and lower guide devices. The guide grooves 14 and 19 comprise the guide grooves 12*b* and 16*b*; parallel straight grooves 14*a* and 19*a*; and approximately L-shaped locking grooves 14*b* and 19*b* provided on both sides of the straight grooves 14*a* and 19*a*.

In the aforementioned structure, the latches 5 on both sides in FIG. 15(*a*) and the right latch 5 in FIG. 15(*b*) are in the standby position. In the standby position, the upper and lower protrusions 52 are locked in the corresponding locking grooves 14*b* and 19*b*, and positions of the latches 5 are controlled although the latches 5 are receiving urging forces accumulated in the urging devices 3 together with the slider 2A. Then, from a state of FIG. 15(*a*), when the sliding door on a left side, which is not shown in the figure and is in the open position, is operated to move in a closing direction from the open position, the striker 9 hits an inner face of a hook portion 50 of the corresponding latch 5, and the latch 5 is rotated by the force thereof so as to be switched to the retraction position as shown on the left side in FIG. 15(*b*) from the standby position. In the retraction position, in a state wherein the latch 5 has restrained the striker 9 inside the hook portion, the upper and lower protrusions 52 enter into the straight grooves 14*a* and 19*a* from the locking grooves 14*b* and 19*b* so as to be unlocked. Consequently, the latch 5 and the slider 2A are slid by the urging force accumulated in the urging device 3 so as to automatically switch the sliding door to the closed position through the striker 9. Also, when the striker 9 is slid to the left side in the figure together with the latch 5 by the opening operation of the sliding door from the closed position, accompanied by that, the urging force is accumulated in the urging device 3. Furthermore, when the sliding door is moved in the open direction, the latch 5 is switched to the standby position again.

PRIOR ART DOCUMENTS

Patent Documents

Patent Document 1: Japanese Patent Application Publication No. 2009-275502

Patent Document 2: Japanese Patent Application Publication No. 2008-144567

SUMMARY OF THE INVENTION

Problems to be Solved by the Invention

In the movement assist device (the slide assist mechanism) disclosed in the Patent Document 1, the striker with a relatively simple structure is disposed inside the transverse groove of the main body frame, and the retraction tool, which requires a more complicated structure and a larger installation space, is disposed in the sliding door. However, in the structure, for example, when the retraction tool is attached, one portion of the door neck protruding on an end face of the sliding door has to be cut away, and after the cutting, the concave-like portion for an installation has to be formed, so that it has not been easy to attach the retraction tool. Additionally, in the retraction tool, a width dimension is restricted up to an extent of approximately 20 mm, so that a high positional accuracy is required for the latch which engages with/disengages from the striker. Also, since one portion of an upper face of the case is open, there has been a problem that dust, dirt, and the like, which can cause an improper actuation, can easily accumulate inside the case.

In the buffer closing device disclosed in the Patent Document 2, in place of the structure in FIG. 15(*a*), the buffer closing device can be structured by right-and-left one side, i.e., a pair of the latches and sliders, and the urging device, and furthermore, the buffer closing device can be structured by the single latch and slider, and the urging device so as to be capable of being applied to the sliding door, which is opened and closed along the transverse groove of the main body frame, as well. In the structure, the retraction tool is disposed in the main body frame, and the striker is disposed in the sliding door. The case of the retraction tool forms a transverse groove-like opening, which allows the striker to come in and out of the case, in the lower face of the case. However, in that case, in addition to a play set between the sliding door and the transverse groove of the main body frame, due to a deformation and the like of the sliding door caused by a continuous use and the like, when the striker comes in and out of the case, the striker can easily interfere with an opening edge on a case side so as to cause the improper actuation. Moreover, when the striker interferes, that cannot be easily corrected.

For the aforementioned problems, an object of the present invention is to provide a movement assist device for the moving body which facilitates a positional accuracy between the latch of the retraction tool and the striker for absorbing even some degree or maintaining, thereby improving a versatility and an actuation property.

Means for Solving the Problems

In order to achieve the aforementioned object, the present invention provides a movement assist device having characteristics of either of the following (1) to (3).

(1) The movement assist device comprises a retraction tool including a case, a latch switched between a standby position which is locked inside the case to be incapable of sliding and a retraction position which releases the aforementioned locking so as to be capable of sliding, and an urging device; and a striker switching the latch from the standby position to the retraction position, or switching the latch from the retraction position to the standby position. Either one of the retraction tool or the striker is respectively provided in a fixed body, or a moving body movably disposed in the fixed body, and also the other of the retraction tool or the striker is provided in the other of the fixed body or the moving body. When the latch is switched from the standby position to the retraction position, the moving body can move by an urging force. In the movement assist device, the case includes a striker leading portion notched in such a way that a width of the case becomes thin up to a middle of the other end from one end in a longitudinal direction. Also, one portion of the latch is exposed and disposed in the leading portion from an inside of the case.

In the present invention having the aforementioned characteristic, the moving body includes a sliding door such as Shoji (a paper sliding door), Fusuma (a thick-paper sliding door), and the like, or a drawer. The fixed body is a rectangular main body frame and the like supporting the moving body (the sliding door, the drawer, or the like) movably. For example, if the moving body is the sliding door, the fixed body is structured by a transverse board or a doorsill on a lower side of the sliding door; a transverse board or a crossbar on an upper side of the sliding door; and vertical boards supporting the doorsill and the crossbar from both sides, and those portions divide an opening portion with a size corresponding to opening and closing of the sliding door. Also, if the moving body is the drawer, the fixed body is an enclosure such as a cabinet and the like dividing a housing space corresponding to the moving body. In that case, of a guide rail (usually, a fixed rail, and a movable rail which is moved along the fixed rail) wherein the movement assist device of the present invention is placed along the enclosure or the drawer, there are presumable structures of being attached to the fixed rail, and of being attached to an intermediate rail of the drawer or the guide rail, or the movable rail. Also, the striker switches the latch of the retraction tool between the retraction position and the standby position. In the standby position, the latch has been locked to be incapable of sliding against the urging force accumulated in the urging device. In the retraction position, for example, the latch is unlocked in a state of restraining an engagement protrusion, and the urging force accumulated in the urging device allows the moving body to move to a closed position from a position of a middle of the opening, or up to an open position from a position of a middle of the closing.

Preferably, the present invention having the aforementioned characteristic further has either one of the following (2) or (3), or both the following (2) and (3). Namely, in the movement assist device of the present invention:

(2) The case includes an installation surface disposed in a corresponding attachment portion of the fixed body or the moving body, and the leading portion is formed in a portion except for the installation surface.

(3) In the case, the width of one end side is provided to be thin. Also, the case further includes a guide portion inclining toward the leading portion.

Effect of the Invention

Due to the aforementioned characteristic (1), the movement assist device of the present invention includes the leading portion notched in a width direction of the case in such a way that the width of the case of the retraction tool becomes thin up to the middle of the other end from one end in the longitudinal direction. Also, one portion of the latch is exposed to an outside in the leading portion thereof from the inside of the case. When the striker is moved along the leading portion of the case, the striker engages with/disengages from the latch outside the case. Accordingly, compared to a conventional movement assist device in which the striker engages with/disengages from the latch inside the case, the movement assist device of the present invention absorbs a relative accuracy between the striker and the latch on a case side, or resolves a risk of a buffer of the striker due to a deformation and the like of the moving body, thereby improving an actuation property. Moreover, unlike the movement assist device disclosed in, for example, the Patent Document 1, the movement assist device of the present invention does not include an opening on an upper end face of the case, so that it is difficult to accumulate dust, dirt, and the like inside the case. Moreover, unlike the buffer closing device disclosed in, for example, the Patent Document 2, in the movement assist device of the present invention, the case does not require an opening or a groove for allowing the striker to come in and out of the case, so that even if the retraction tool is made compact, light, and thin, a rigidity of the case can be maintained.

Also, due to the aforementioned characteristic (2), in the movement assist device of the present invention, the case of the retraction tool forms the striker leading portion in the portion except for the installation surface which is disposed in the corresponding attachment portion of the fixed body or the moving body, so that as inferred from each embodiment, without damaging a stable attachment property of the retraction tool and the like, the movement assist device of the present invention can be implemented.

Due to the aforementioned characteristic (3), in the movement assist device of the present invention, as for the case, the width of one end side is provided to be thin, and also the case includes the guide portion inclining toward the leading portion. Accordingly, the striker can move to the leading portion excellently by a guide function of the guide portion thereof, thereby further improving the actuation property.

BRIEF DESCRIPTION OF THE DRAWINGS

FIG. 1(*b*) is a perspective view separately showing a retraction tool structuring the movement assist device according to the first embodiment of the present invention.

FIG. 2(*b*) is a schematic perspective view showing essential parts of the sliding door.

FIG. 4(*b*) is a drawing wherein the latch of the retraction tool is viewed from a direction shown by an arrow assigned A in FIG. 4(*a*).

FIG. 4(*c*) is a drawing wherein the latch of the retraction tool is viewed from a direction shown by an arrow assigned B in FIG. 4(*a*).

FIG. 5(*b*) is a drawing wherein the slider of the retraction tool is viewed from a direction shown by an arrow assigned C in FIG. 5(*a*).

FIG. 5(*c*) is a drawing wherein the slider of the retraction tool is viewed from a direction shown by an arrow assigned D in FIG. 5(*a*).

FIG. 7(*b*) is a drawing wherein a longitudinal cross-sectional surface of the light-blocking member is enlarged.

FIG. 8(*b*) is a diagram wherein the sliding door when the latch is in the standby position is viewed from above in the application example of the movement assist device according to the first embodiment.

FIG. 8(*c*) is an enlarged pattern diagram wherein the retraction tool shown in FIG. 8(*b*) is enlarged.

FIG. 9(*b*) is a diagram wherein the sliding door when the latch is in the retraction position is viewed from above in the application example of the movement assist device according to the first embodiment.

FIG. 9(*c*) is an enlarged diagram wherein the retraction tool shown in FIG. 9(*b*) is enlarged.

FIG. 10(*b*) is a drawing showing a relationship between the sliding door and the retraction tool and the like in the application example of the movement assist device according to the second embodiment of the present invention.

FIG. 10(*c*) is a drawing showing a state wherein the sliding door is fitted into the transverse groove in the application example of the movement assist device according to the second embodiment of the present invention.

FIG. 11(*b*) is a drawing showing the vicinity of the upper end portion of the lateral face of the sliding door.

FIG. 11(*c*) is an end view of the sliding door.

FIG. 13(*b*) is a diagram when the latch of the retraction tool is in the retraction position in the application example of the movement assist device according to the second embodiment.

FIG. 14(*b*) is a diagram when a latch is in the standby position in the application example of the buffer closing device disclosed in the Patent Document 1.

FIG. 14(*c*) is a diagram when the latch is in the retraction position in the application example of the buffer closing device disclosed in the Patent Document 1.

FIG. 15(*b*) is an actuation view of essential parts of the retraction tool in the device disclosed in the Patent Document 2.

BEST MODES OF CARRYING OUT THE INVENTION

Figure 1A:
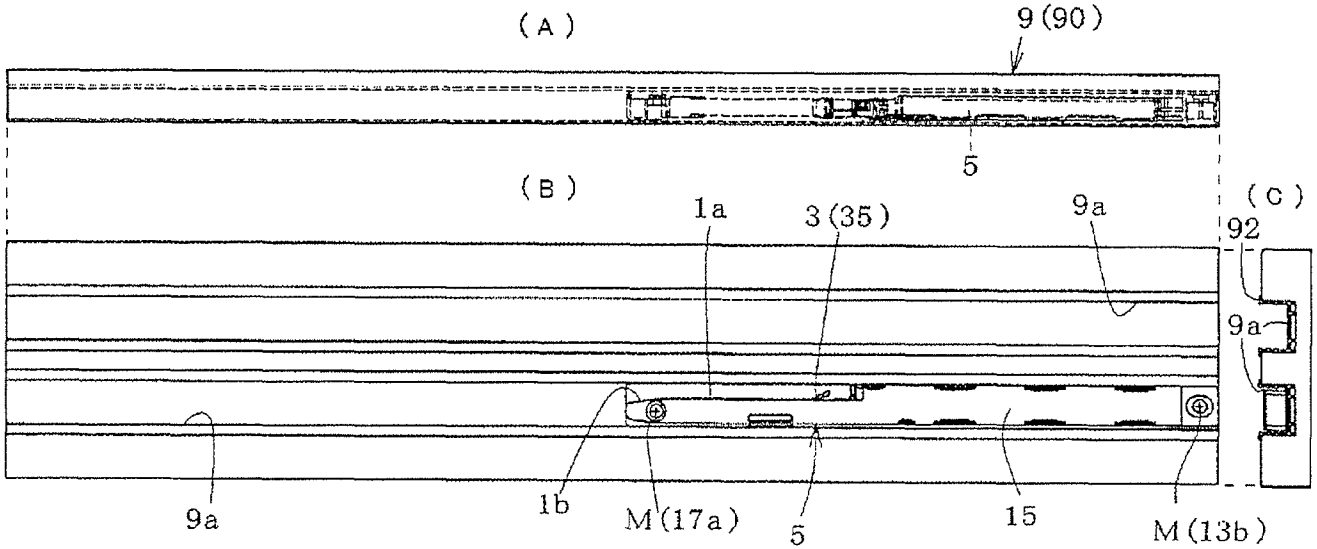
FIG. 1(*a*) is an application example of a movement assist device according to the first embodiment of the present invention, wherein (A) is a side view of a crossbar (a transverse board) of a main body frame; (B) is a bottom view of the crossbar (the transverse board) viewed from a lower side; and (C) is an end view of the crossbar (the transverse board).
Figure 1B:
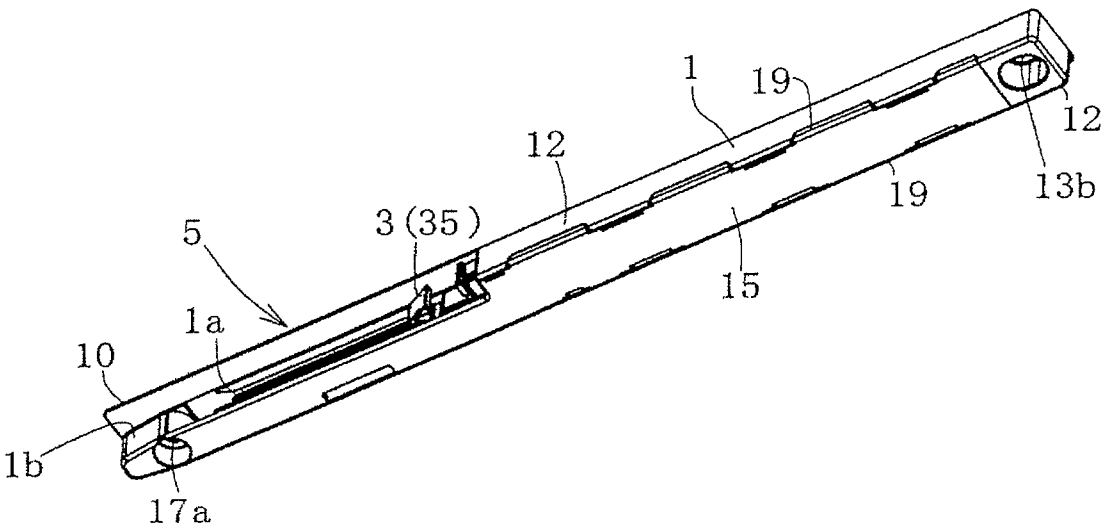

Embodiments of the present invention will be explained with reference to the drawings. FIG. 1(*a*) to FIG. 9(*c*) show the first embodiment of the present invention, and FIG. 10(*a*) to FIG. 13(*b*) show a second embodiment of the present invention. In the following explanation, a main portion of the first embodiment, a retraction tool thereof, a sliding door and a striker, a receiving member, a light-blocking member, an actuation, modifications of the second embodiment, and the actuation will be described in detail in that order. Incidentally, in the accompanying figures, one portion of a structure is simplified, or is omitted due to the limitations of drawing figures.

Main Portion of the First Embodiment

Figure 2A:
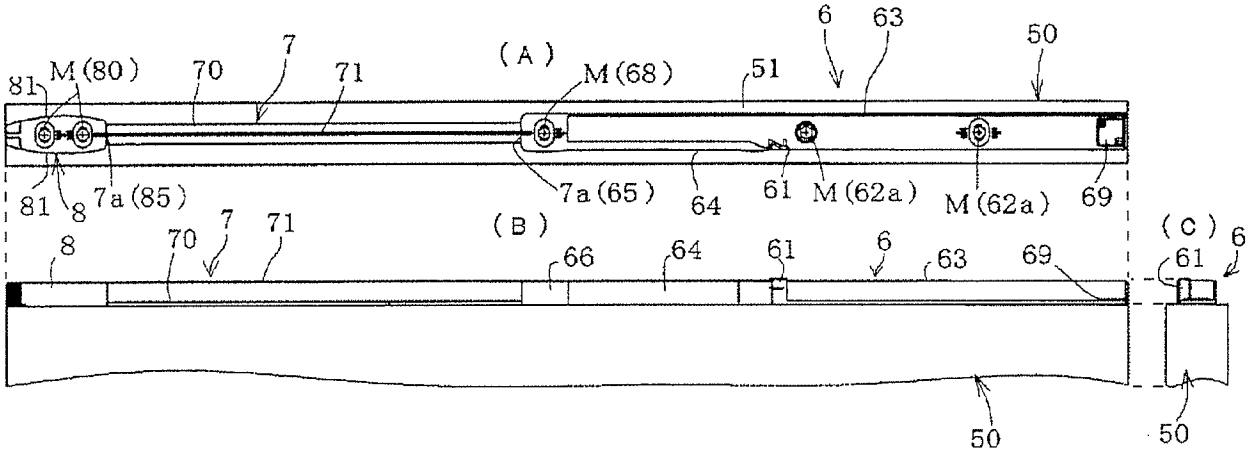
FIG. 2(*a*) is a drawing showing a relationship between a sliding door and a striker of the first embodiment, wherein (A) is a top view of the sliding door; (B) is a drawing showing a vicinity of an upper end portion of a lateral face of the sliding door; and (C) is an end view of the sliding door.
Figure 2B:
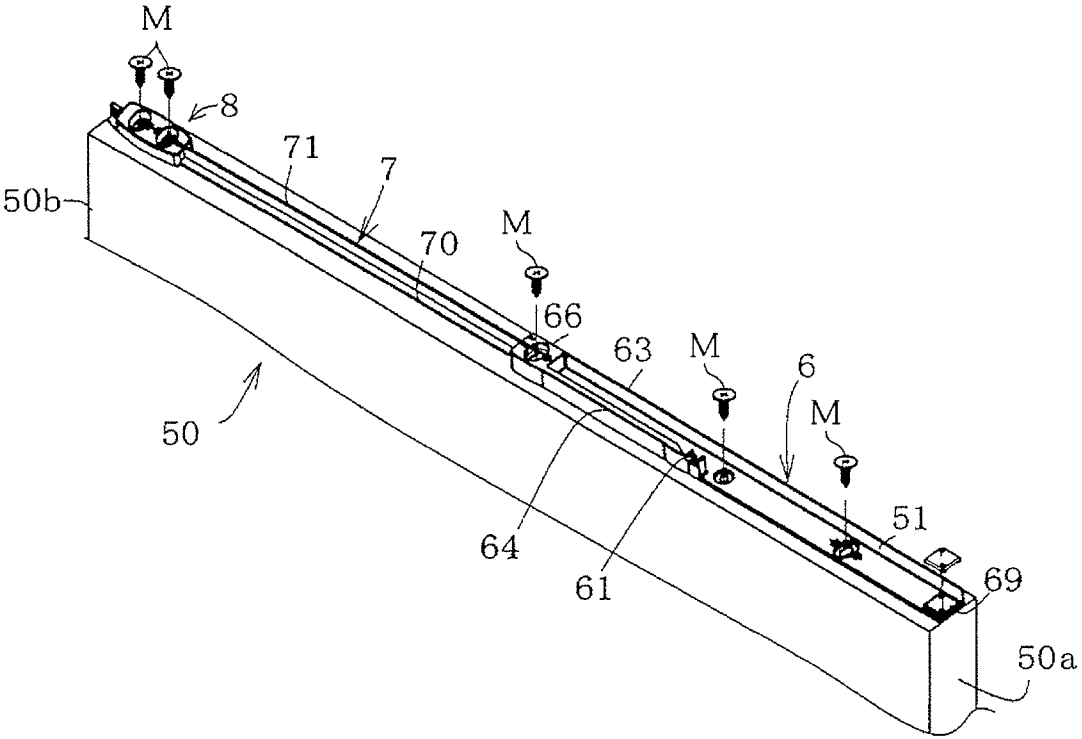

A movement assist device of the first embodiment is structured by a retraction tool 5 and a striker 6. As for a sliding door 50 which is one example of a moving body, and a main body frame 9 which is one example of a fixed body, among a structure of moving between an open position and a closed position, the movement assist device of the first embodiment especially is directed to the sliding door 50 with a door neck which fits into transverse grooves 9*a* of the main body frame 9. Incidentally, in the moving body and the fixed body, in place of the sliding door 50 and the main body frame 9 of the present example, for example, a drawer may be the moving body, and a main body frame may be the fixed body. In that case, it may be a structure allowing the drawer to move between a pull-out position and a housed position of the main body frame which is the fixed body. Then, as shown in FIG. 1(*a*) and FIG. 1(*b*), in the main body frame 9, there is attached the retraction tool 5 inside the transverse grooves 9*a* provided in a crossbar (a transverse board) 90. Incidentally, as shown in FIG. 1(*a*) and FIG. 1(*b*), in the transverse grooves 9*a*, there is placed a frame member 92 whose cross-sectional surface is C shape (i.e., approximately equal to a shape wherein one side of a rectangle is removed). As shown in the later-mentioned second embodiment, the frame member 92 is not an essential structure in the embodiment of the present invention, and can be omitted as necessity. As shown in FIG. 2(*a*) and FIG. 2(*b*), an upper end face 51 of the sliding door 50 is an approximately rectangular flat face, and there are provided to line up the striker 6, a light-blocking member 7, and a receiving member 8 on an approximately straight line. By a shape of the striker 6 and the receiving member 8, the door neck with a predetermined length is formed.

Incidentally, the door neck formed by the striker 6 and the receiving member 8 has a dimension which fits into a groove of the transverse grooves 9*a* of the main body frame, and usually, a groove width is set in approximately 15 to 20 mm. The main body frame 9 divides a rectangular opening, which is opened or closed by the sliding door 50, for example, by the crossbar 90 on an upper side and a doorsill (the transverse board) on a lower side, and vertical boards 91 on both sides. In the crossbar 90, there is formed a pair of the transverse grooves 9*a* in parallel which corresponds to the door neck. The first embodiment is an example in which the sliding door 50 corresponds to the transverse grooves 9*a* of the crossbar 90, and in which the door neck with the predetermined length is formed by standing walls 63 and 64, and the receiving member 8 structuring a door-neck forming portion of the striker 6 on the upper end face 51 of the sliding door 50.

(Retraction Tool)

The retraction tool 5 includes a case 1 provided to be disposed in the transverse grooves 9*a*; a slider 2 slidably disposed in the case 1; a latch 3 switched between a standby position wherein the latch 3 is pivotally supported at the slider 2, and locks (locks to be incapable of sliding) in a corresponding portion of the case 1, and a retraction position in which the locking is released so as to be capable of sliding; an urging device S; and a braking device 4. Then, in the present embodiment, when the latch 3 is switched from the standby position to the retraction position, due to an urging force accumulated in the urging device S, the sliding door 50 is pulled in, for example, from the open position to the closed position.

Figure 3:
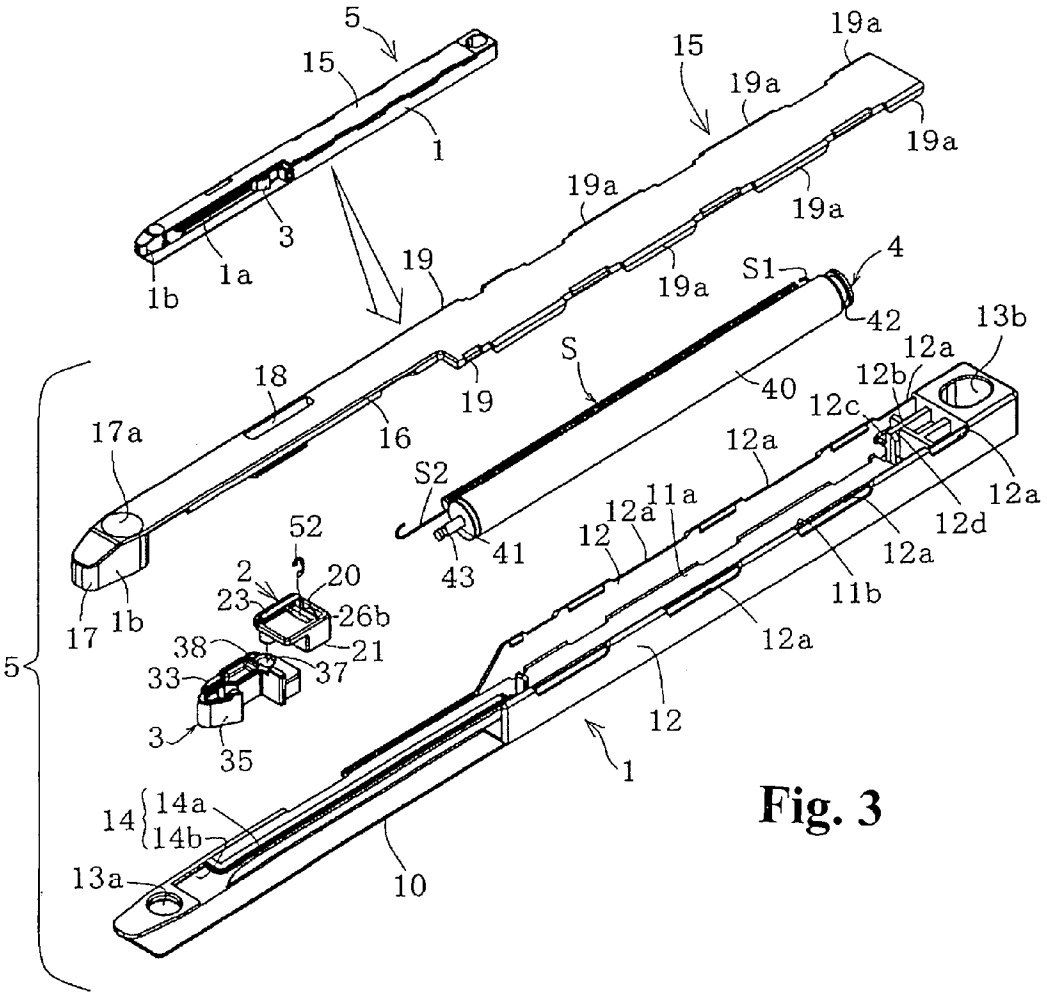
FIG. 3 is an exploded perspective view of the retraction tool.

Here, as shown in FIG. 2(*a*), FIG. 2(*b*), and FIG. 3, the case 1 is, for example, a slender resin injection-molded body having a width attachable to the transverse grooves 9*a*. The case 1 includes a leading portion 1*a* notched on an inward side in a width direction (a direction perpendicular to a longitudinal direction) of the case 1 in such a way that the width becomes thin up to a middle of the other end from one end in the longitudinal direction. Additionally, the case 1 includes a guide portion 1*b* inclining toward the leading portion 1*a* from one end side. Then, an internal space of the case 1 is divided from an outside by a lower face 10 which becomes an installation surface in the transverse grooves 9*a* when the retraction tool 5 is attached to the transverse grooves 9*a* of the crossbar 90; both lateral faces 12; and a cover 15 attached to the case 1 so as to close an opening of an upper side of the case 1.

Inside the case 1, there are provided an urging-device placement portion 11*a* and a braking-device placement portion 11*b* formed in two lines on both sides along the longitudinal direction; attachment holes 13*a* and 13*b* formed to pass through on both end sides in the longitudinal direction; a vertical wall 12*b* provided to stand just in front of the attachment hole 13*b*; a locking portion 12*c* provided on a placement portion 11*a* side of the vertical wall 12*b*, and locking one end S1 of a coil spring which is the urging device S; a control portion 12*d* provided on a placement portion 11*b* side, and locking an end portion of a cylinder 40 which is the braking device 4; and a guide portion 14. The guide portion 14 includes a straight groove 14*a* located between the placement portion 11*a* and the placement portion 11*b*, and extending toward a just front of the attachment hole 13*a* from an approximately intermediate position; and a locking groove 14*b* inflected in an approximately L shape just in front of an attachment hole 13*a* side from the straight groove 14*a*.

In the cover 15, there are provided an urging-device placement portion and a braking-device placement portion corresponding to the case 1, which are not shown in the figure; a leading portion 16 whose one side is notched in the longitudinal direction, and which guides an engagement protrusion 61 of the striker 6 to a center side in the width direction of the cover 15; an attachment portion 17 overlaid on an end portion side of the case 1 in such a way that a hole 17*a* overlays on the attachment hole 13*a*; a guide piece which is not shown in the figure, and restrains a looseness of the coil spring which is the urging device S; a control portion which is not shown in the figure, provided on an end portion side on an opposite side to the attachment portion 17, and holds the end portion of the cylinder 40, which is the braking device 4, from above; and a guide portion which is not shown in the figure, and corresponds to the guide portion 14. The guide portion which is not shown in the figure includes a straight groove corresponding to the straight groove 14*a*, and an approximately L-shaped locking groove corresponding to the locking portion 14*b*. In FIG. 3, the reference numeral 18 represents a concave portion provided for forming the guide piece.

On both the lateral faces 12 of the case 1, and both lateral faces 19 of the cover, there are provided a plurality of a pair of a locking portion 12*a* and an engagement portion 19*a* mutually engaging when the cover 15 is overlaid on the case 1. Then, when the cover 15 is placed on the case 1 in such a way that a plurality of the respective engagement portions 19*a* of the cover 15 engages with the corresponding locking portions 12*a* of the case 1, the latch 3 is disposed between the cover 15 and the case 1 in such a way as to be exposed to the outside from the leading portion 16 (the leading portion 1*a* of the retraction tool 5) of the cover 15. The aforementioned case 1 and the cover 15 are designed in such a way that except for a portion forming the leading portion 16, height and width dimensions of respective outer shapes are the same as those of a door neck provided in a conventional sliding door, i.e., that the case 1 and the cover 15 combine the conventional door neck. In other words, in the outer shape of the case 1, except for the leading portion 1*a* and the guide portion 1*b*, both the lateral faces 12 and 19, and an outer surface of the cover 15 form to divide the door-neck forming portion which is an alternative to the conventional door neck, so that the later-mentioned second embodiment can be used.

Figure 5A:
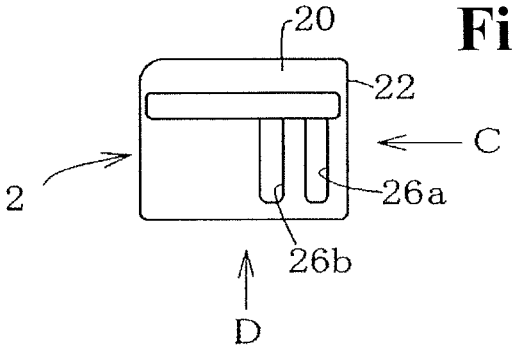
FIG. 5(*a*) is a top view of a slider of the retraction tool.
Figure 5B:
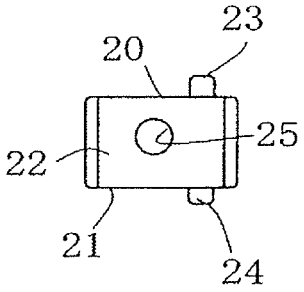
Figure 5C:
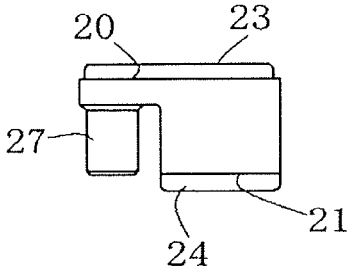

As shown in FIG. 3, FIG. 5(*a*), and FIG. 5(*c*), the slider 2 forms a small block shape made of resin which is disposed in a space between the case 1 and the cover 15, and includes convex portions 23 and 24 provided in upper and lower faces 20 and 21; through-bores 26*a* and 26*b*; an insertion hole 25 provided on a back face 22, and communicating with the through-bores 26*a* and 26*b*; and a connecting axis portion 27 provided under an upper face 20 side. Incidentally, in FIG. 3, the upper face 20 is disposed on a cover 15 side; the convex portion 23 fits into the guide portion on the cover 15 side; the lower face 21 is disposed on a case 1 side; and the convex portion 24 fits into the guide portion 14. In the through-bore 26*b*, there is disposed a retaining ring 52 in FIG. 3.

In the braking device 4, there is used a piston-type damper. The piston-type damper may be a heretofore known piston-type damper (for example, the piston-type damper disclosed in Japanese Unexamined Patent Publication No. 2006-29564), and may have a structure including the cylinder 40 and a piston rod 41 which is gently protruded and entered with respect to the cylinder 40, for example, a structure wherein the piston rod 41 gently drives relative to the cylinder 40 on a fixed side. As shown in FIG. 3, the cylinder 40 includes a neck-like locking groove 42 on an outer circumference of a back end, and the piston rod 41 includes a neck-like locking groove 43 on an outer circumference of an end.

Figure 4A:
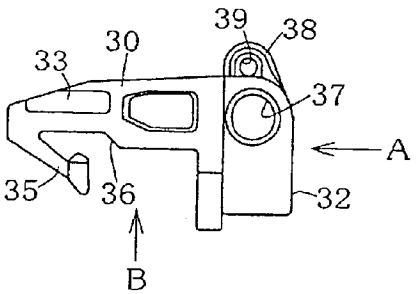
FIG. 4(*a*) is a top view of a latch of the retraction tool.
Figure 4B:
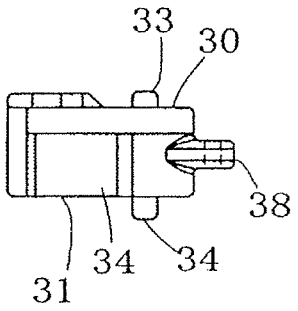
Figure 4C:
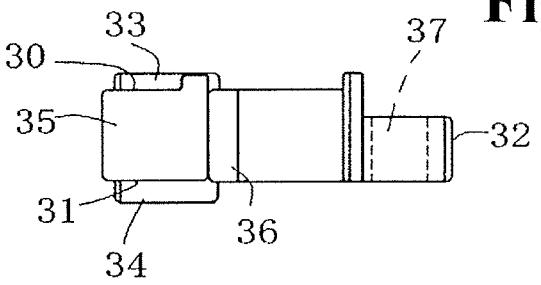

As shown in FIG. 3, and FIG. 4(*a*) to FIG. 4(*c*), the latch 3 is a resin molded body having approximately the same thickness as the slider 2, and includes convex portions 33 and 34 provided in upper and lower faces 30 and 31; a pivotal support hole 37 provided near a back face 32, and passing through in an up-and-down direction; a claw portion 35 provided on an opposite side to the back face 32, i.e., on a front side; a restraint portion 36 wherein an inside of the claw portion 35 is notched; and a spring locking portion 38 provided to protrude on one lateral portion from a back face 32 side. Incidentally, in FIG. 3, the upper face 30 is disposed on the cover 15 side; the convex portion 33 fits into the guide portion on the cover 15 side; the lower face 31 is disposed on the case 1 side; and the convex portion 34 fits into the guide portion 14. In the pivotal support hole 37, there is fitted the axis portion 27. The locking portion 38 includes a latch-holding hole 39, and there is locked the other end S2 of the urging device S in the latch-holding hole 39.

Figure 8A:
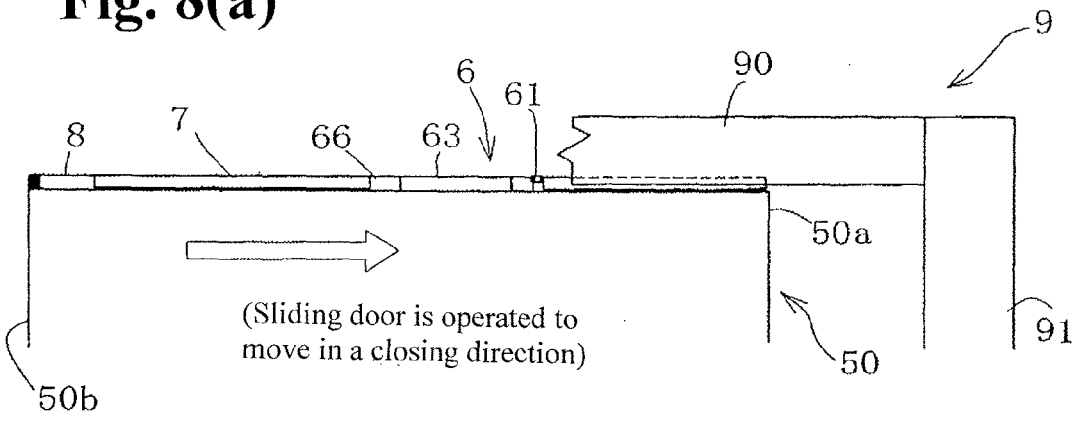
FIG. 8(*a*) is a diagram of an upper portion of the sliding door when the latch is in a standby position in the application example of the movement assist device according to the first embodiment.
Figure 8B:
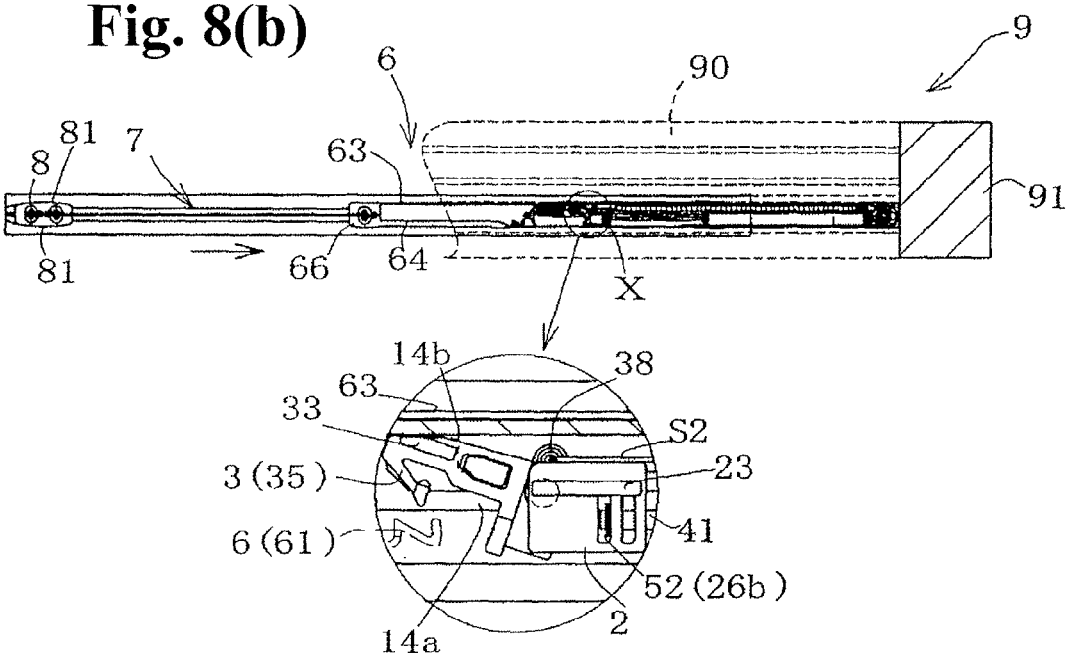
Figure 8C:
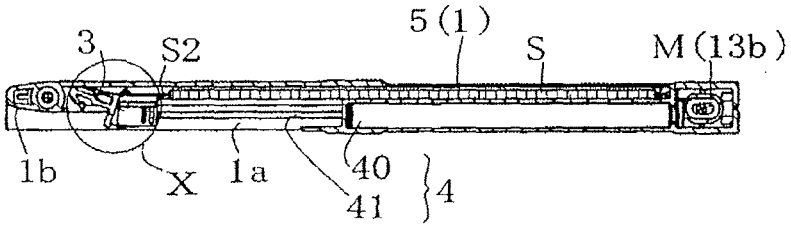
Figure 9A:
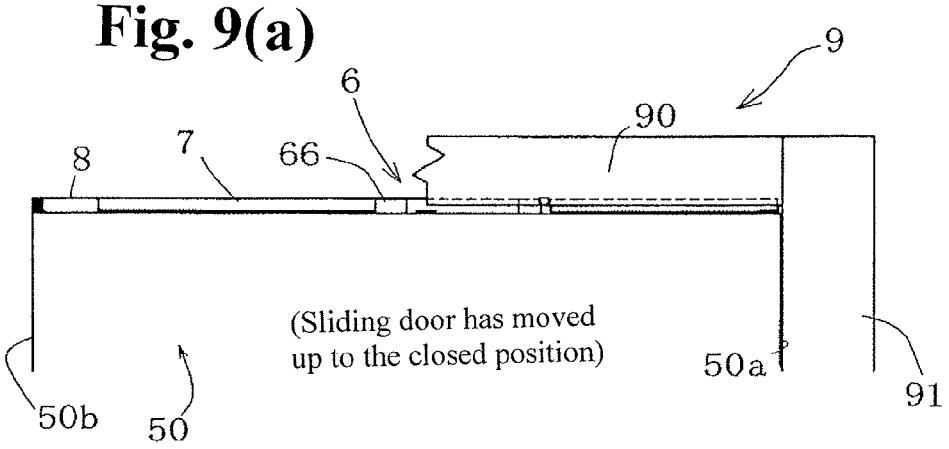
FIG. 9(*a*) is a diagram of the upper portion of the sliding door when the latch is in a retraction position in the application example of the movement assist device according to the first embodiment.
Figure 9B:
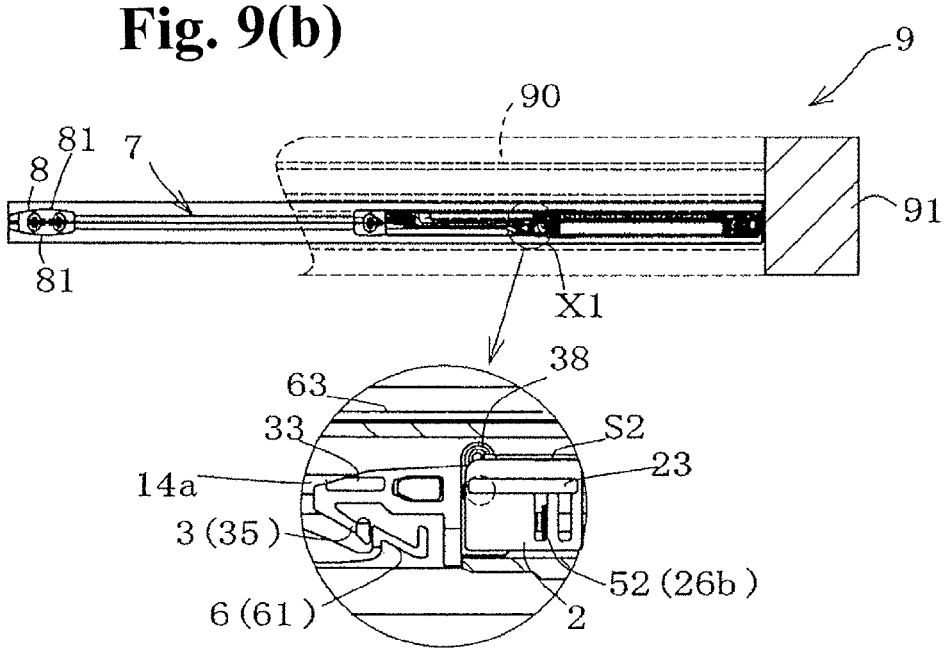
Figure 9C:
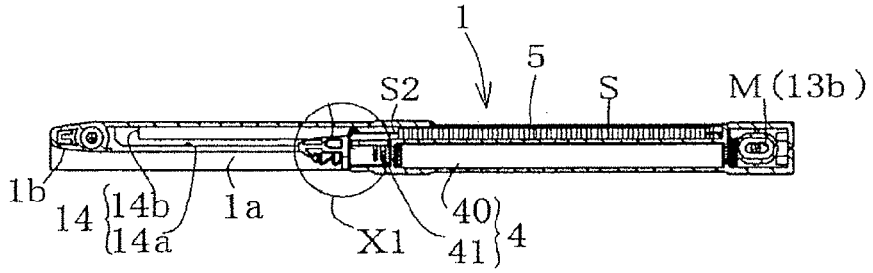

In the urging device S, there is used the coil spring in the present embodiment. As shown in FIGS. 9(*a*) to 9(*c*), an overall dimension of the coil spring is approximately equal to a length of the cylinder 40 in a state wherein the coil spring has released an accumulating elastic force up to the degree where the coil spring does not have the urging force. As shown in FIGS. 8(*a*) to 8(*c*), the coil spring allows the urging force to be accumulated by being stretched long through the piston rod 41. On both ends, there are provided the attaching locking portions S1 and S2.

The aforementioned respective members are incorporated into the case 1 together with the piston-type damper, which is the braking device 4, and the coil spring, which is the urging device S, for example, in a state wherein the slider 2 and the latch 3 are connected through an engagement of the axis portion 27 and the pivotal support hole 37. Also, the cover 15 is attached to the case 1 so as to be completed as the retraction tool 5. In that case, as shown in enlarged views of FIG. 8(*a*) to FIG. 8(*c*), and FIG. 9(*a*) to FIG. 9(*c*), in the piston rod 41, the end of the rod is inserted into the insertion hole 25 relative to the slider 2, and the retaining ring 52 is engaged with the locking groove 43 on the outer circumference of the end of the rod inside the through-bore 26*b*, so that the piston rod 41 is connected. The braking device 5, the slider 2, and the latch 3 are disposed along the placement portion 11*b* of the case 1. Then, the cylinder 40 is positioned and fixed in the case 1 by engaging the locking groove 42 with the aforementioned control portion 12*d* (and the control portion, which is not shown in the figure, on a cover side).

The slider 2 and the latch 3 are slidably disposed in the case 1 in a state wherein the convex portion 24 and the convex portion 34 on the lower side fit into the guide portion 14 of the case 1 (also, the convex portion 23 and the convex portion 33 on the upper side fit into the guide portion, which is not shown in the figure, on the cover side). In the coil spring which is the urging device S, the locking portion S1 on one end side is latched and held in the locking portion 12*c* of the case 1, and the locking portion S2 on the other end side is locked on the latch-holding hole 39 of the locking portion 38 on a latch side. Then, the latch 3 is switched between the retraction position wherein the convex portions 33 and 34 are slid along the straight groove 14*a* accompanied by sliding of the slider 2, and the standby position wherein the convex portions 33 and 34 enter into the locking groove 14*b* from the straight groove 14*a* so as to be locked to be incapable of sliding. Incidentally, in the example, the locking portion S2 on the other end of the coil spring, which is the urging device S, is locked in the latch 3. However, in place of this, the locking portion S2 on the other end may be locked in a slider 2 side.

As shown in FIG. 1(*a*) and FIG. 1(*b*), the aforementioned retraction tool 5 is operated to be fixed relative to the transverse grooves 9*a* by a screw M which is inserted into the hole 17*a* and the attachment hole 13*a*, and a screw M which is inserted into the attachment hole 13*b* in a state wherein the lower face 10, which is the installation surface thereof, is disposed in such a way as to be seated in an inner bottom face in the transverse grooves 9*a* of the crossbar 90. Also, the aforementioned attachment structure is set in such a way that both the lateral faces 12 of the case 1, and one lateral face 19 of both the lateral faces 19 of the cover 15, wherein the leading portion 1*a* (16) is formed, tightly abut against one inner side face of the transverse grooves 9*a*. Also, the attachment structure is set in such a way that the other lateral face 19 holds a slight gap between the other lateral face 19 and the other inner side face of the transverse grooves 9*a*. The gap has a dimension allowing the standing wall 63 structuring the door-neck forming portion in the later-mentioned striker 6 to escape.

(Sliding Door and Striker)

In the first embodiment, as shown in FIG. 2(*a*) and FIG. 2(*b*), the sliding door 50 is formed in a state without the door neck, i.e., in the example, the upper end face 51 is formed in the flat face. The sliding door 50 forms the door neck by one portion of the striker 6, which is located on the upper end face 51 thereof, and is disposed between right-and-left ends 50*a* and 50*b* of the sliding door 50, and the receiving member 8. Also, the sliding door 50 includes the light-blocking member 7 disposed between the striker 6 and the receiving member 8.

Figure 6:
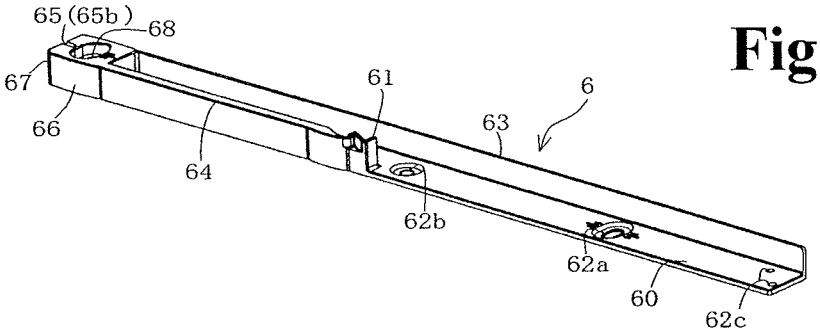
FIG. 6 is a perspective view showing the striker separately.

The striker 6 is a resin injection-molded body, and as shown in FIG. 6, there are integrally formed an attachment portion 60 extending in an elongated manner; the engagement protrusion 61 located in an approximately intermediate position of the attachment portion 60, and provided to protrude in one lateral edge; the standing wall 63 provided to stand in an approximately L shape along one lateral edge of the attachment portion 60; the standing wall 64 located in the other lateral edge of the attachment portion 60, and provided to stand in the approximately L shape along the engagement protrusion 61 and one end side; and a receiving portion 66 with an approximately rectangular solid provided in one end.

The attachment portion 60 has the same width dimension as that of the door neck which fits into the transverse grooves 9*a*, and includes an attachment hole 62*a* with a long hole shape, an attachment hole 62*b* with a circular shape, and an attachment hole 62*c* provided in an end portion on an opposite side to the receiving portion 66. As shown in FIGS. 2(*a*) and 2(*b*), in the attachment hole 62*c*, there is placed along a gap-absorbing spacer 69 as necessity. The engagement protrusion 61 is engaged with/disengaged from the latch 3 of the retraction tool 5. The standing walls 63 and 64, and the receiving portion 66 are set in the door-neck forming portion of the sliding door 50. Also, the receiving portion 66 is divided by both lateral faces 66, upper and lower faces, and an end face 67, and as shown in FIGS. 2(*a*) and 2(*b*), the receiving portion 66 forms a device for attaching the light-blocking member 7 to the upper end face 51 with respect to the receiving member 8, and has a door-neck forming function of the sliding door 50.

Namely, in the receiving portion 66, an attachment hole 68 is provided in a center portion, and also a fitting groove 65 with an approximately inverted T shape is provided in the end face 67. As shown in FIG. 6, the fitting groove 65 comprises a horizontal groove 65*a* (which is not shown in the figure) on a lower side, and a vertical groove 65*b*, and has a groove shape capable of fitting a corresponding end portion 74 of the light-blocking member 7. Namely, in the corresponding end portion 74 of the light-blocking member 7, an end portion 70*a* of a horizontal portion 70 is fitted into the aforementioned horizontal groove, and an end portion 71*a* of a light-blocking portion 71 is fitted into the vertical groove 65*b*. The above-mentioned striker 6 is attached relative to the upper end face 51 of the sliding door 50 by the three screws M which are inserted and passed through the attachment holes 62*a* and 62*b*, and the attachment hole 68. The attachment holes 62*a* and 68 have the long hole shape, and when the striker 6 is straightly attached to the upper end face 51, the attachment holes 62*a* and 68 allow the striker 6 to be minutely adjusted in the width direction.

(Receiving Member)

Figure 7A:
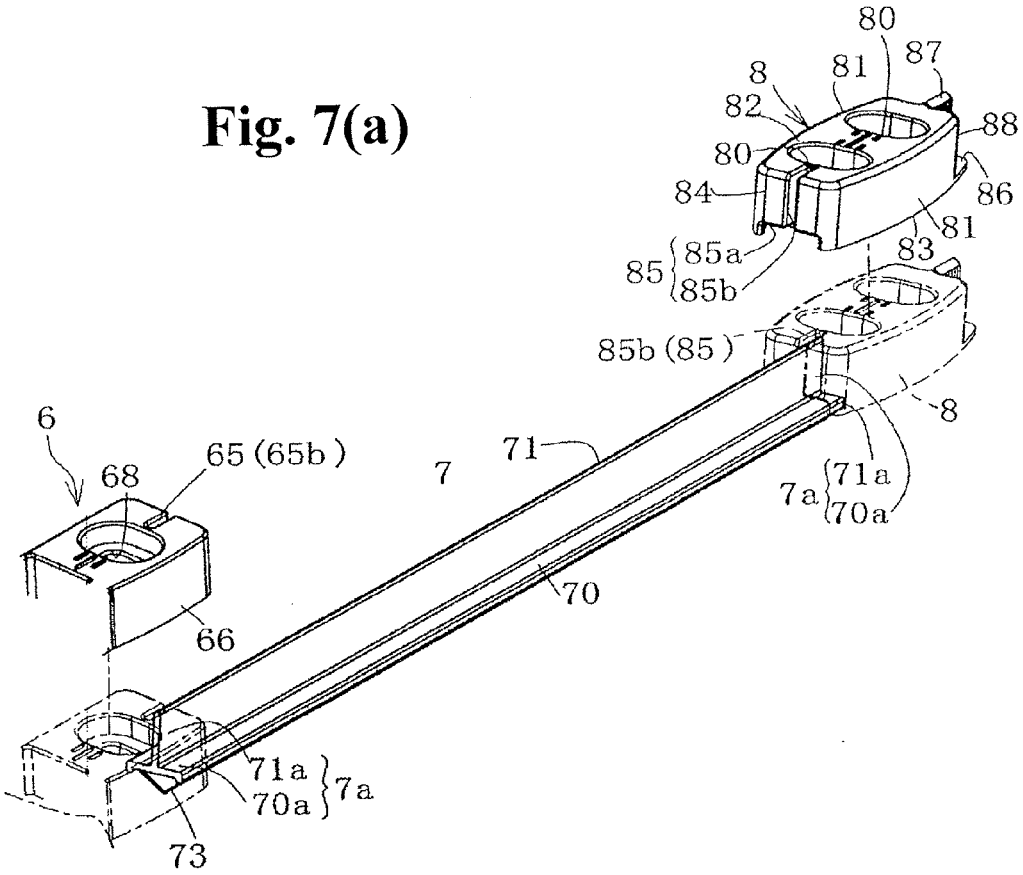
FIG. 7(*a*) is a perspective view showing a light-blocking member disposed between the striker and a receiving member.
Figure 7B:
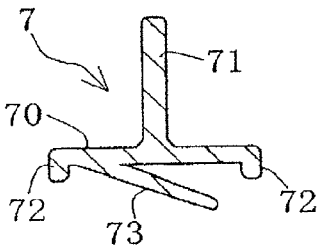

As shown in FIG. 2(*a*), FIG. 2(*b*), FIG. 7(*a*), and FIG. 7(*b*), the receiving member 8 is the same as the aforementioned receiving portion 66 in that the receiving member 8 forms the device for attaching the light-blocking member 7 to the upper end face 51 of the sliding door 50, and has the door-neck forming function. Namely, the receiving member 8 comprises a resin molded body roughly divided by both lateral faces 81, upper and lower faces 82 and 83, and front and back end faces 84 and 88. In the receiving member 8, there are provided two attachment holes 80 passing through the upper and lower faces 82 and 83; a fitting groove 85 with an approximately inverted T shape ditched in the front end face 84; and a locking vertical wall 87 protruded on the back end face 88, and positioned on a seat portion 86 extending from a lower side of the back end face 88. Incidentally, the back wall 87 is a portion which is used when the receiving member 8 is used for a drawing-apart sliding door, and may be omitted in a case of the sliding door except for the drawing-apart sliding door.

As shown in FIG. 2(*a*) and FIG. 2(*b*), each attachment hole 80 formed in the receiving member 8 has a long hole shape which is long in the width direction, and when the receiving member 8 is attached onto an extended line of the striker 6 in the upper end face 51 of the sliding door 50 using the screw M, an attachment position thereof can be minutely adjusted in the width direction of the upper end face 51. The fitting groove 85 includes a vertical groove 85*b* and a horizontal groove 85*a* on a lower side, and has a groove shape which can fit the corresponding end portion of the light-blocking member 7. Namely, in the corresponding end portion of the light-blocking member 7, the end portion 70*a* of the horizontal portion 70 is fitted into the horizontal groove 85*a*, and the end portion 71*a* of the light-blocking portion 71 is fitted into the vertical groove 85*b*.

(Light-Blocking Member)

The sliding door 50 is formed in the state without the door neck, i.e., in the example, the upper end face 51 is formed in the flat face, and there, the door neck is formed by the striker 6 and the receiving member 8, so that the light-blocking member 7 is the member blocking a light so as to prevent the light inside a room from leaking to an outside from a portion without the door neck. Namely, the light-blocking member 7 is made of an elastic material such as resin, rubber, and the like, and a longitudinal cross-sectional surface has an approximately inverted T shape. The light-blocking member 7 includes the horizontal portion 70; the light-blocking portion 71 protruding vertically (vertically upward) relative to the horizontal portion 70; leg portions 72 provided downward from both sides of the horizontal portion 70; and an elastic abutting portion 73 extending obliquely downward lower than the leg portions 72 from a lower face of the horizontal portion 70 between both leg portions 72, and those are integrally formed. Also, in a state of being attached to the upper end face 51 of the sliding door 50, the light-blocking member 7 has approximately the same height dimension compared to the receiving portion 66 of the striker 6 and the receiving member 8, and a width dimension is set smaller than the width of the case 1.

The aforementioned light-blocking member 7 is attached relative to the upper end face 51 of the sliding door 50 in a state of being engaged with the receiving portion 66 of the striker 6 and the receiving member 8, whose both sides are fixed to the upper end face 51. In the attachment state, in the light-blocking member 7, the elastic abutting portion 73 presses against the upper end face 51, and the light-blocking portion 71 prevents the light from leaking through the transverse grooves 9*a* while in use of the sliding door 50. Incidentally, as for an attachment method of the light-blocking member 7 to the sliding door 50, in place of a method allowing the sliding door 50 to be engaged, the light-blocking member 7 may be adhered relative to a corresponding end face of the sliding door 50 by an adhesive agent, a double-faced adhesive tape, and the like. Also, the light-blocking member 7 may be pressed into an attachment portion of the sliding door 50.

(Actuation)

FIG. 8(*a*) to FIG. 8(*c*), and FIG. 9(*a*) to FIG. 9(*c*) show the actuation of the above-mentioned movement assist device, i.e., the retraction tool 5 and the striker 6.

(1) FIG. 8(*a*) to FIG. 8(*c*) show a process wherein the sliding door 50 is operated to move in a closing direction from the open position. In that process, as shown in the enlarged view of FIG. 8(*b*), the latch 3 structuring the retraction tool 5 is in the standby position. In the standby position of the latch 3, the coil spring which is the urging device S is stretched, and is accumulating the urging force. In the latch 3, the convex portions 33 and 34 are locked in the locking groove 14*b* on a case side and the locking groove on the cover side so as to control a position of the slider 2 against the urging force of the urging device S.

(2) In the above-mentioned movement assist device, first, when the sliding door 50 is moved in the closing direction from the open position, the engagement protrusion 61 of the striker is guided by the guide portion 1*b* of the retraction tool 5 attached inside the transverse grooves 9*a* so as to be moved along the leading portions 1*a* and 16. Also, the standing wall 63 is moved along the corresponding lateral face of the case 1 so as to be positioned relative to the retraction tool 5 with a high degree of accuracy. Therefore, in the structure of the present example, even in a case where the sliding door 50 has a room relative to the transverse grooves 9*a* (the width of the sliding door 50 is smaller than the width of the transverse grooves 9*a*), the engagement protrusion 61 of the striker 6 and the latch 3 of the retraction tool 5 are locked or unlocked as designed.

(3) When the sliding door 50 is moved further in the closing direction, the engagement protrusion 61 hits a corresponding portion of the latch 3. The latch 3 is rotated counterclockwise as a supporting point of the axis portion 27 by stress thereof. Due to a rotation thereof, the convex portions 33 and 34 are unlocked from the locking groove 14*b*, and are fitted into the straight groove 14*a*, and the latch 3 is switched to the retraction position. At the same time, the engagement protrusion 61 is restrained inside the claw portion 35 on the latch side, i.e., in the restraint portion 36.

(4) FIG. 9(*a*) to FIG. 9(*c*) show a state wherein the sliding door 50 has moved up to the closed position by the urging force of the urging device S after the latch 3 has been switched to the retraction position. Namely, in the movement assist device, as shown in the enlarged view of FIG. 9(*b*), when the latch 3 is switched to the retraction position, the latch 3 restrains the engagement protrusion 61 in the restraint portion 36 on the latch side. In the restrained state, the sliding door 50 is associated with the slider 2 together with the latch 3 which are slid by the urging force of the urging device S so as to be moved up to the closed position. In that case, in the embodiment, when the sliding door 50 is moved by the urging force of the urging device S, the aforementioned braking device 4 applies a brake on the sliding door, so that the sliding door 50 is slid gently.

(5) The light-blocking portion 71 of the light-blocking member 7 can prevent the light inside the room from leaking to the outside from the upper end face 51 of the sliding door 50 when the sliding door 50 is in the closed position. In a process wherein the sliding door 50 is operated to move in an open direction from the closed position, the latch 3 is moved to a left side together with the slider 2 through the engagement protrusion 61 which has been engaged with the restraint portion while remaining in the retraction position. Due to the movement, the urging force is accumulated in the urging device S. When the sliding door 50 is moved further in the open direction, as shown in FIG. 8(*a*) to FIG. 8(*c*), in the latch 3, the convex portions 33 and 34 reach the locking groove 14*b* from the straight groove 14*a*. Then, while the latch 3 is rotating clockwise as the supporting point of the axis portion 27 by the stress when the engagement protrusion 61 presses the claw portion 35 and comes out of the restraint portion 36, the convex portions 33 and 34 engage with the locking groove 14*b*, so that the latch 3 is switched to the standby position. The urging force accumulated in the urging device S is maintained as long as the latch 3 is in the standby position.

(6) Due to the above-mentioned structure, the movement assist device according to the present embodiment can be manufactured in a manner of manufacturing the sliding door 50 in a state wherein the end face 51 on a door neck side is formed in the flat face compared to the conventional sliding door with the door neck, and in a manner of forming the door neck by placing the striker 6 and the receiving member 8 along the flat face thereof. Accordingly, labor required for manufacturing the sliding door 50 can be reduced so as to be capable of easily employing the movement assist device. Moreover, there includes the light-blocking member 7 disposed between the aforementioned door-neck forming portions 63 and 64, and the receiving member 8 so as to be capable of preventing the light inside the room from leaking to the outside.

Modifications of the Second Embodiment

Figure 10A:
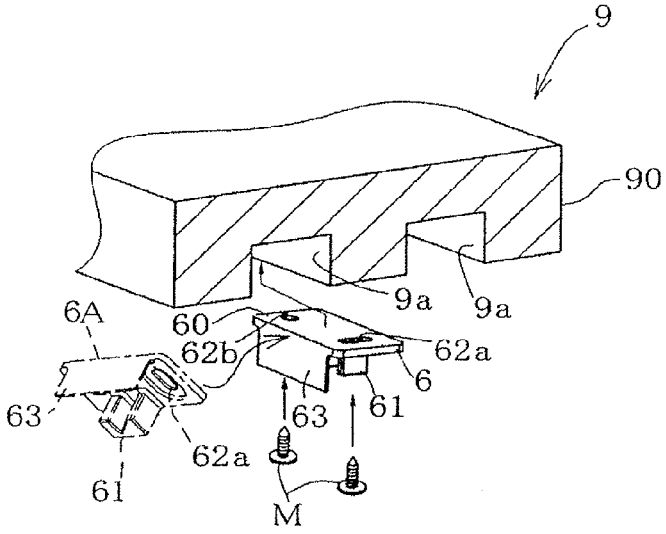
FIG. 10(*a*) is a drawing showing a relationship between a transverse groove of the main body frame and the striker in an application example of the movement assist device according to a second embodiment of the present invention.
Figure 10B:
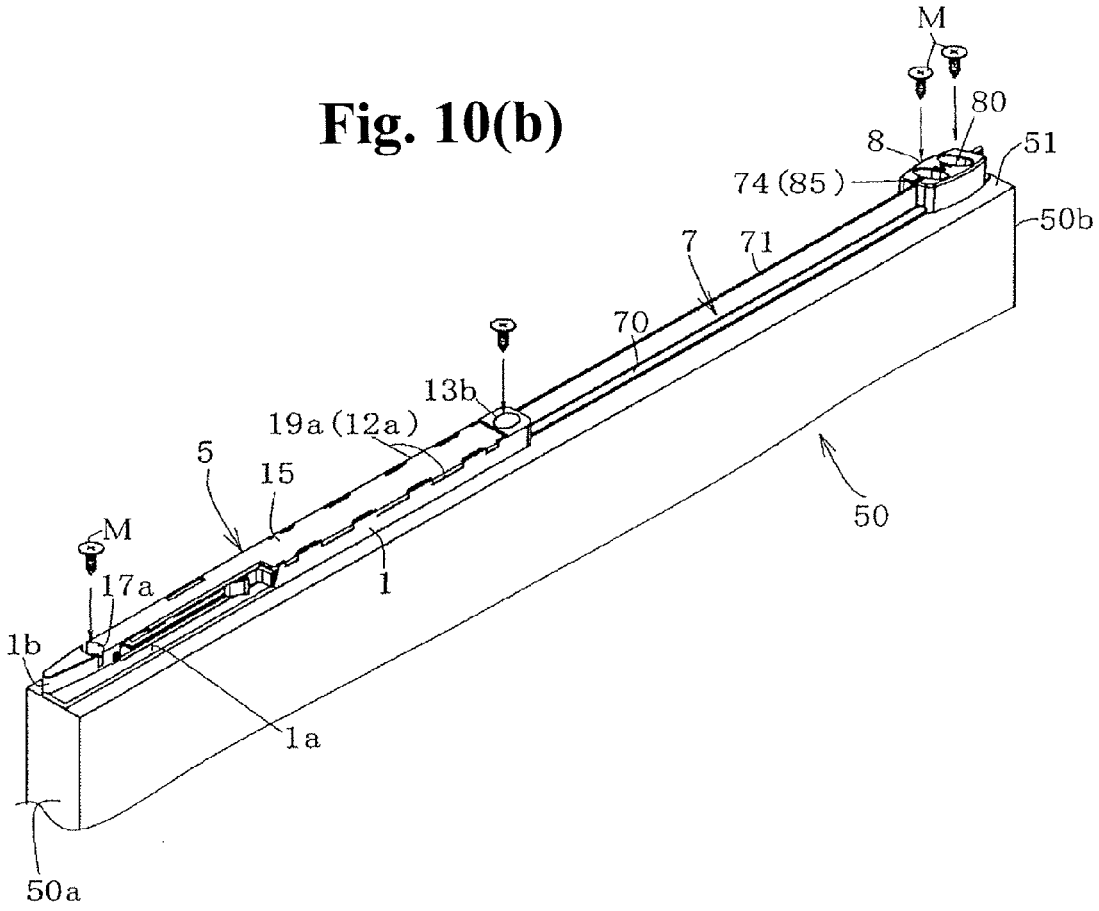
Figure 10C:
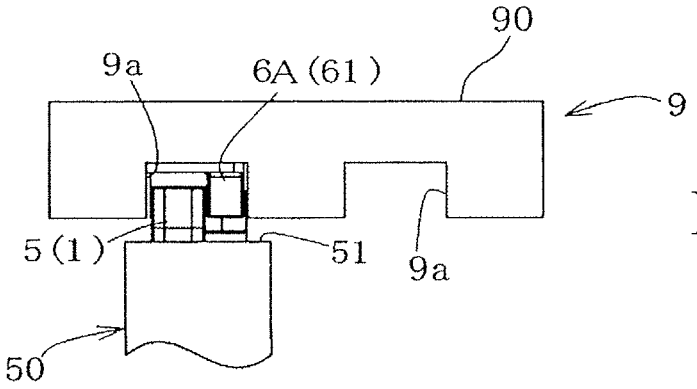
Figure 11A:
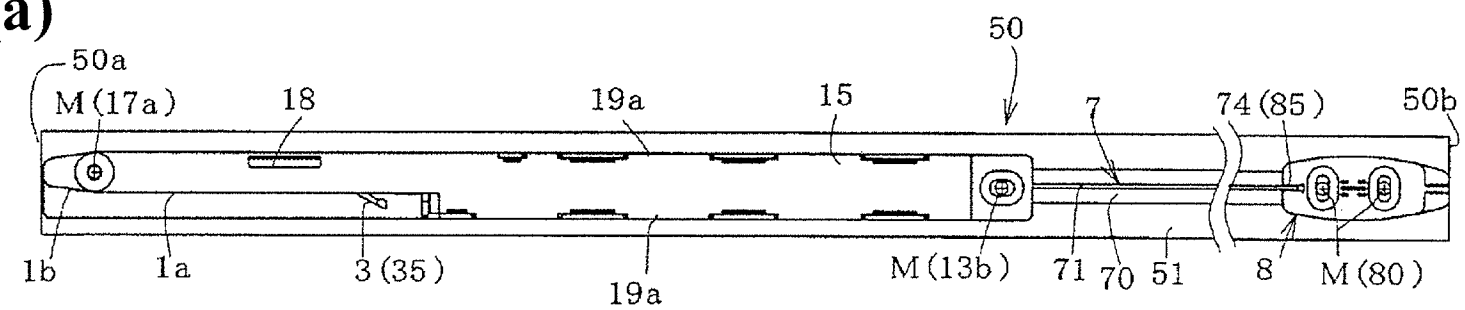
FIG. 11(*a*) is a top view showing essential parts of an upper face of the sliding door in detail.
Figure 11B:
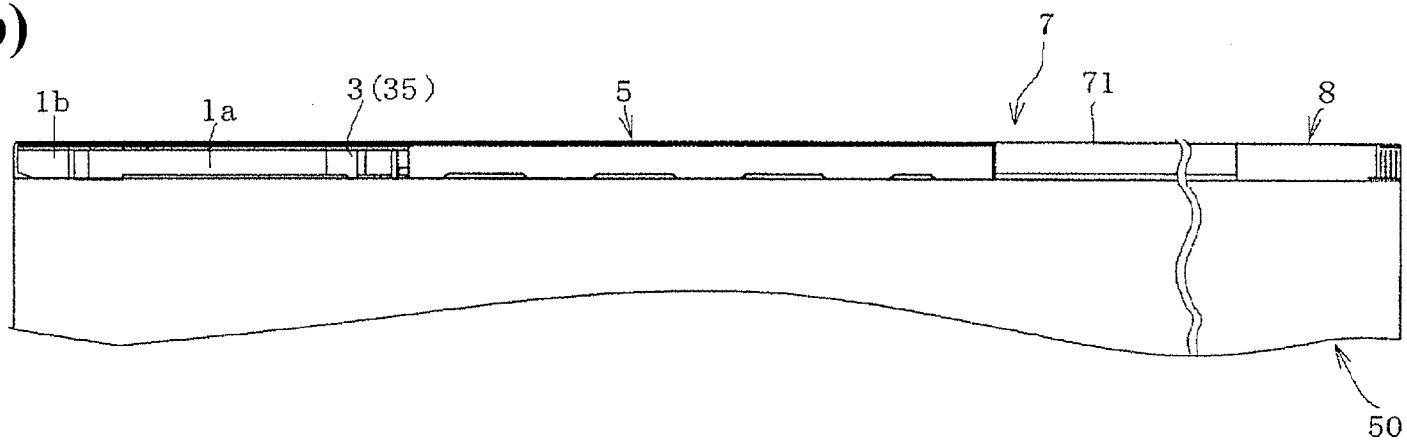
Figure 11C:
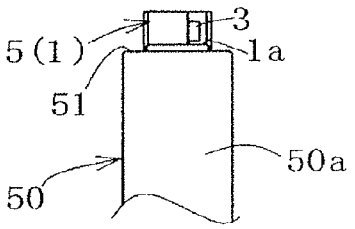
Figure 12:
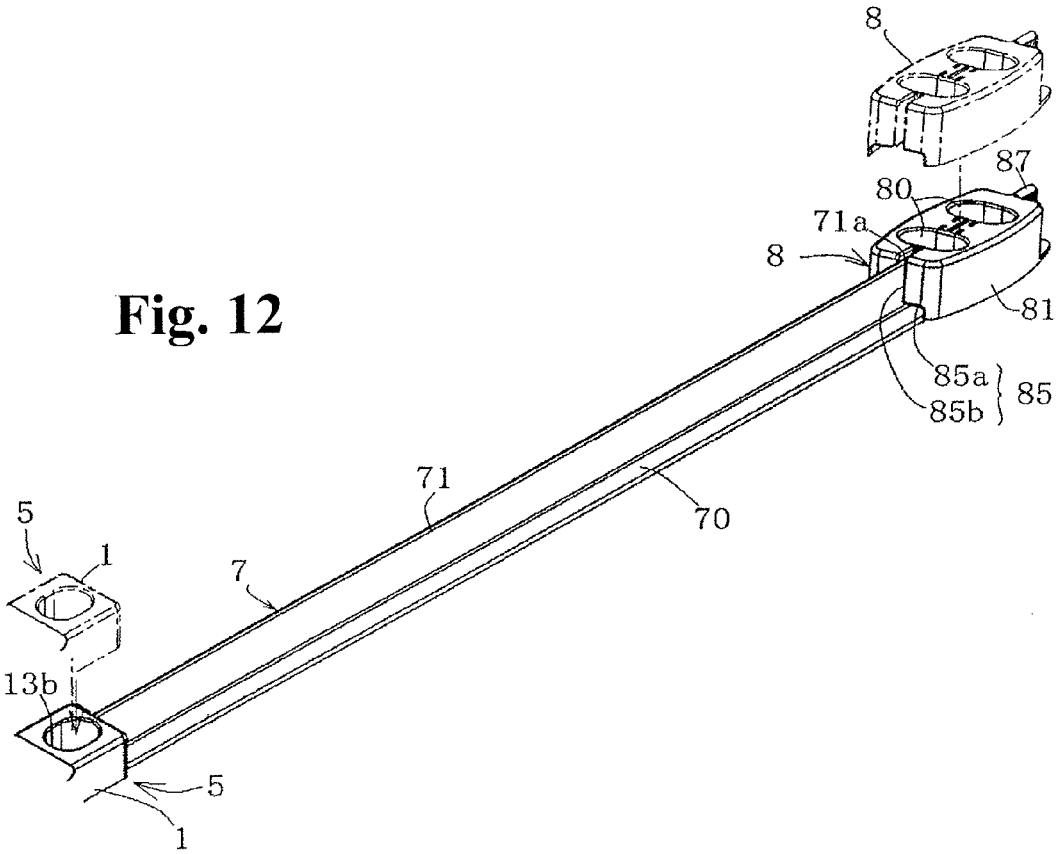
FIG. 12 is a perspective view of the light-blocking member disposed between the case of the retraction tool and the receiving member.
Figure 13A:
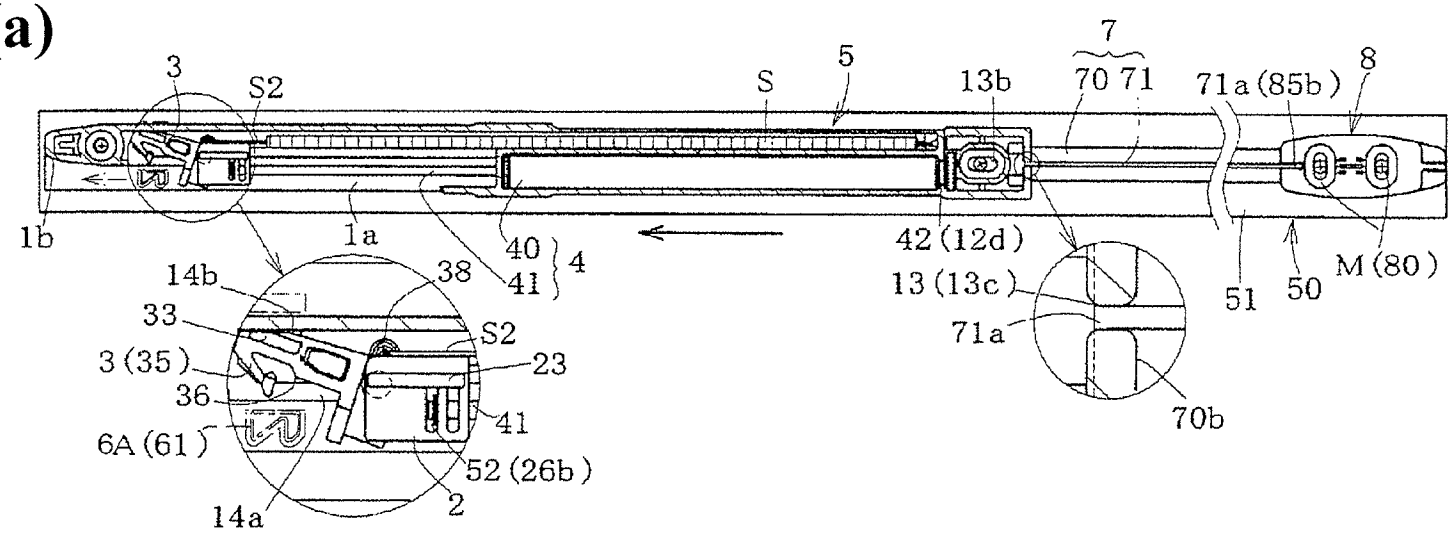
FIG. 13(*a*) is a diagram when the latch of the retraction tool is in the standby position in the application example of the movement assist device according to the second embodiment.
Figure 13B:
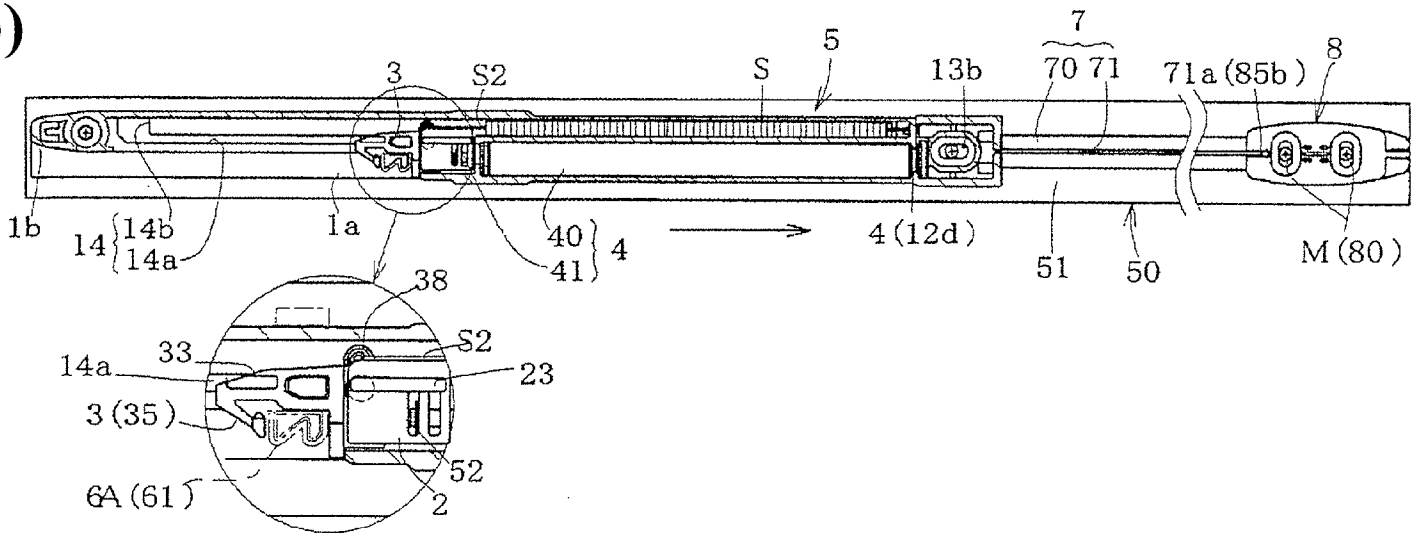
Figure 14A:
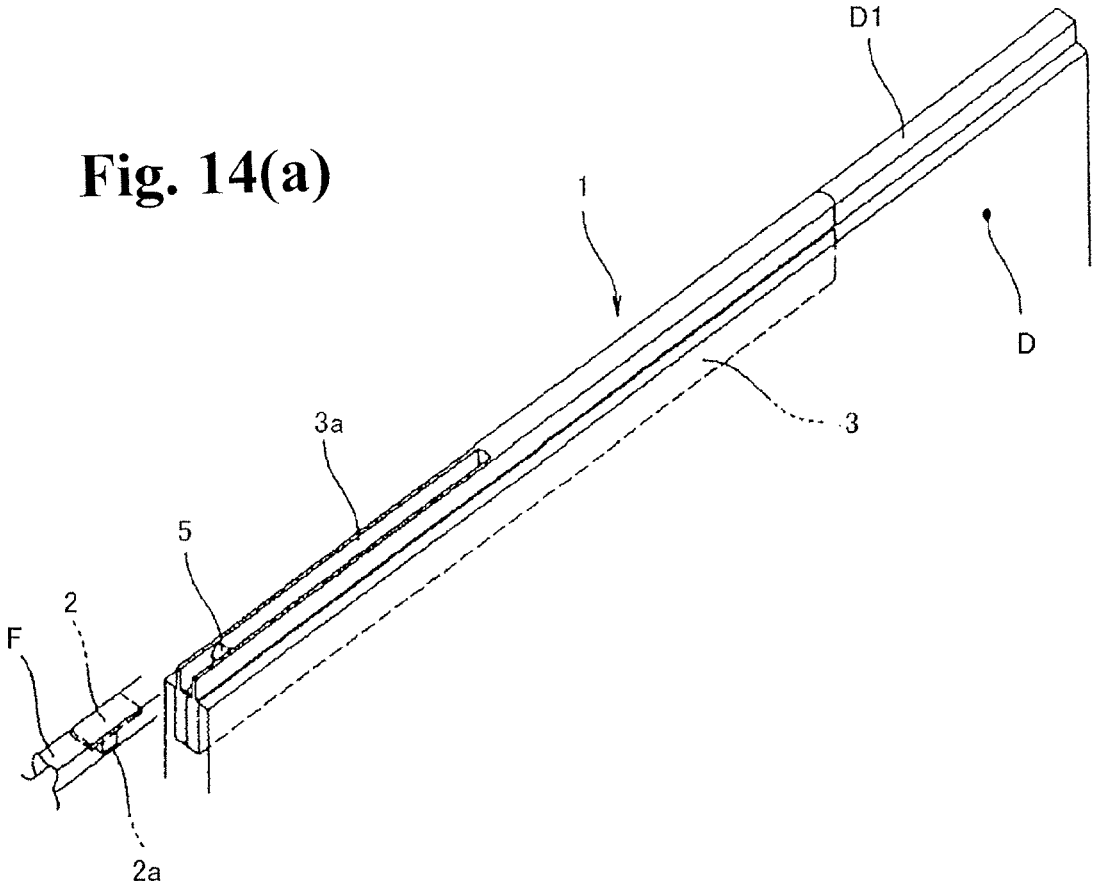
FIG. 14(*a*) is a layout drawing showing a striker attached to a main body frame, and a retraction tool attached to a sliding door in an application example of a buffer closing device disclosed in Patent Document 1.
Figure 14B:
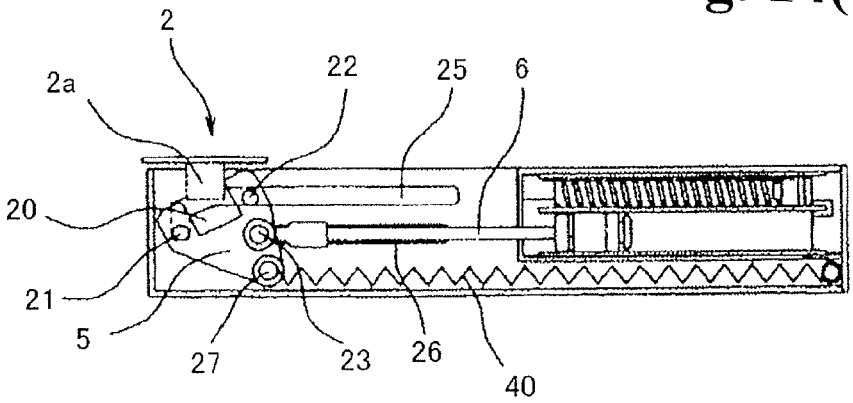
Figure 14C:
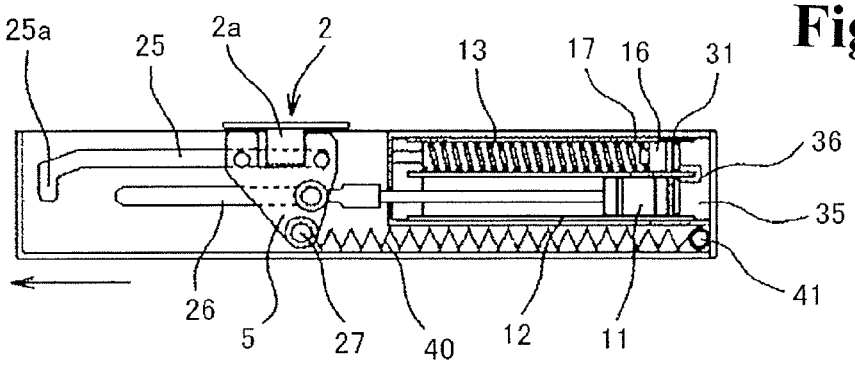
Figure 15A:
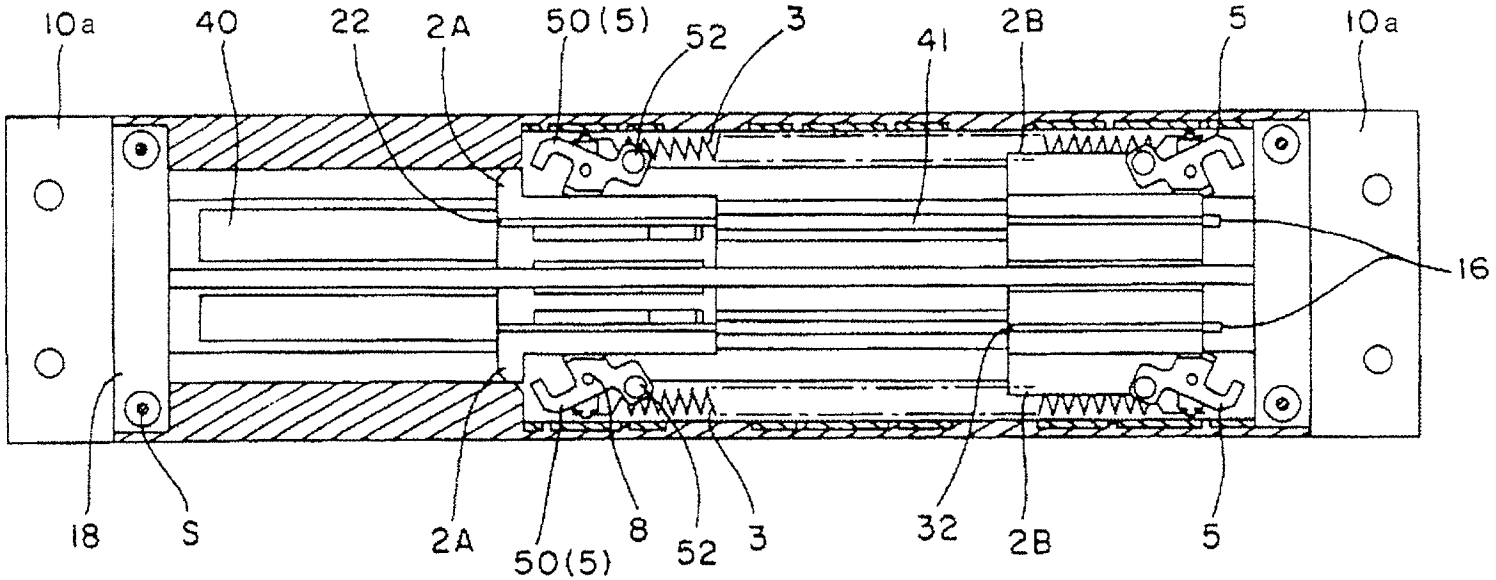
FIG. 15(*a*) is a structural view of a retraction tool in a device disclosed in Patent Document 2.
Figure 15B:
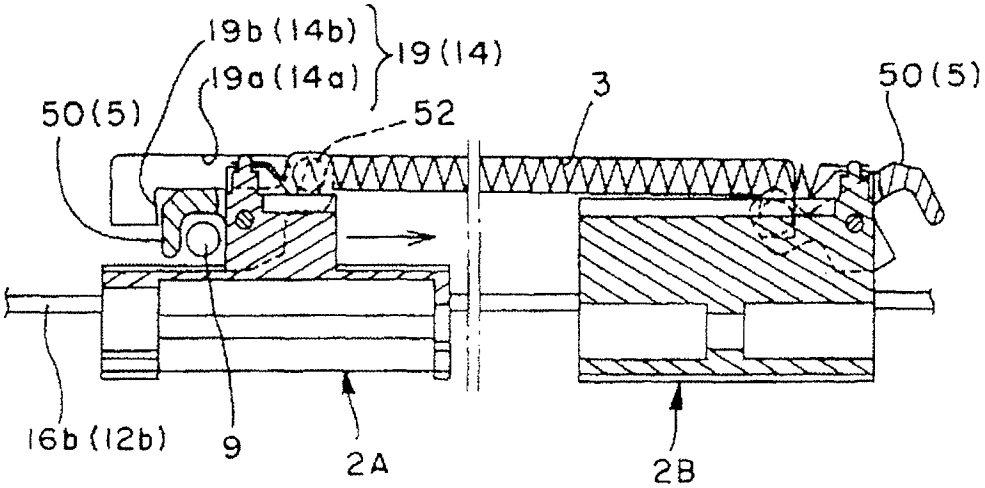

FIG. 10(*a*) to FIG. 13(*b*) show a sliding-door assist device of the second embodiment. In the explanation, a modified structure will be explained by assigning the same reference numeral to the same member and the functionally same portion as the first embodiment, and omitting the explanation thereof as much as possible. Namely, in the sliding-door assist device of the second embodiment, the structure itself of the retraction tool 5, the light-blocking member 7, and the receiving member 8 is the same as the movement assist device of the first embodiment. However, the sliding-door assist device of the second embodiment differs from the movement assist device of the first embodiment in that the retraction tool 5, the light-blocking member 7, and the receiving member 8 are disposed on the upper end face 51 of the sliding door 50, and in that a structure of a striker 6A differs and the striker 6A is disposed in the transverse grooves 9*a* on a main body frame side.

FIG. 10(*a*) to FIG. 10(*c*) show a placement example wherein the case 1 of the retraction tool 5, the light-blocking member 7, and the receiving member 8 are provided to be disposed on the approximately straight line between the right-and-left ends 50*a* and 50*b* of the sliding door 50 on the upper end face 51 which is formed in a flat shape of the sliding door 50. In the placement, the retraction tool 5 is attached by two screws M inserted and passed through the hole 17*a* and the attachment hole 13*b*, and the light-blocking member 7 is respectively connected through a fitting structure or an engagement structure between the corresponding end portion side of the case 1 and the receiving member 8, i.e., through the fitting or the engagement (see an enlarged view on the right side of FIG. 13(*a*)) between one end portion 74 of the light-blocking member 7 and a fitting groove 13*c* of the case 1, and through the fitting or the engagement between the other end portion 74 of the light-blocking member 7 and the fitting groove 85 of the receiving member 8.

As mentioned above, the second embodiment is the sliding door 50 with the door neck as the first embodiment. However, the second embodiment has the advantages that due to the outer shape of the case 1 structuring the retraction tool 5, or since the door neck is formed by the outer shape of the case 1 and the outer shape of the receiving member 8, a manufacturing cost of the sliding door 50 can be reduced, and embedding the retraction tool 5 into the sliding door 50 can be also carried out without a special process as shown in the Patent Document 1. Additionally, the second embodiment can connect and fix the light-blocking member 7 without a gap between the case 1 and the single receiving member 8.

As shown in FIGS. 10(*a*) to 10(*c*), the striker 6 of the second embodiment is the injection-molded body in which the attachment portion 60 and the engagement protrusion 61 provided to protrude in the attachment portion 60 are integrally formed. The attachment portion 60 has a width dimension which can fit in the transverse groove 9*a*, and includes a guide plate portion 63 folded at a right angle on one side, and two attachment holes 62*a* and 62*b*. The striker 6 is attached to the transverse groove 9*a* by two screws M inserted and passed through the attachment holes 62*a* and 62*b* after the attachment portion 60 is positioned and disposed in the groove inner bottom face. In that case, the attachment hole 62*a* is also not the circular shape, and has the long hole shape whose width direction is enlarged, and when the striker 6 is straightly attached to the transverse groove 9*a*, the attachment hole 62*a* allows the striker 6 to be minutely adjusted in the width direction.

In the striker 6, in the attachment state, the engagement protrusion 61 protrudes inside the transverse groove. The guide plate portion 63 faces the engagement protrusion 61 by maintaining a predetermined gap (a gap with the same or a slightly larger width dimension of a portion forming a portion wherein the leading portion 1*a* is provided in the retraction tool 5). When the sliding door 50 is moved along the transverse groove 9*a*, the guide plate portion 63 allows the corresponding lateral faces 12 and 19 (the lateral face on an opposite side to the leading portion 1*a*) of the retraction tool 5 to move along the wall face with a high degree of accuracy. In the above-mentioned structure, there is the advantage that without applying any process to the transverse groove 9*a*, the striker 6 can be easily attached.

(Actuation)

FIG. 13(*a*) and FIG. 13(*b*) show a retraction actuation of the sliding-door assist device of the second embodiment, i.e., the retraction tool 5 and the striker 6A.

(1) FIG. 13(*a*) assumes a process wherein the sliding door 50 is operated to move in an arrow direction of the same figure, i.e., in the closing direction from the open position. Here, the standby position of the latch 3 structuring the retraction tool 5 is shown with the striker 6. In the standby position of the latch 3, the coil spring which is the urging device S is stretched and is accumulating the urging force. In the latch 3, the convex portions 33 and 34 are locked in the locking groove 14*b* on the case side and the locking groove, which is not shown in the figure, on the cover side so as to control the position of the slider 2 against the urging force of the urging device S.

(2) Then, for example, when the sliding door 50 is moved slightly just in front of the closed position from the open position, the engagement protrusion 61 of the striker 6, which is positioned and fixed, is relatively moved along the leading portion 1*a* (16) from the guide portion 1*b* provided on one end side of the retraction tool 5, so that the retraction tool 5 abuts against the corresponding portion of the latch 3 which is exposed to the outside from an inside of the case 1. Then, the latch 3 is rotated counterclockwise as the supporting point of the axis portion 27 by the stress receiving from the engagement protrusion 61, and due to the rotation thereof, the convex portions 33 and 34 are unlocked from the corresponding locking groove 14*b*, and are fitted into the corresponding straight groove 14*a*, so that the latch 3 is switched to the retraction position. At the same time, the engagement protrusion 61 is restrained inside the claw portion 35 on the latch side, i.e., in the restraint portion 36.

(3) FIG. 13(*b*) shows a state wherein the sliding door 50 has moved by the urging force of the urging device S, and has been switched to the closed position after the latch 3 has been switched to the retraction position. Namely, in the sliding-door assist device, when the latch 3 is switched to the retraction position as shown in the same figure, the slider 2 is slid by the urging force of the urging device S together with the latch 3 in a state wherein the engagement protrusion 61 has been restrained in the restraint portion 36 on the latch side. Accompanied by that, the sliding door 50 is moved up to the closed position. In that case, in the embodiment, when the sliding door 50 is moved by the urging force of the urging device S, by receiving the brake of the aforementioned braking device 4, the sliding door 50 is gently moved. In the closed position of the sliding door 50, since there includes the light-blocking member 7 connected without any gap between the retraction tool 5 and a receiving member 8A, for example, the light inside the room can be prevented from leaking to the outside.

(4) In a process wherein the sliding door 50 is operated to move in an arrow direction of FIG. 13(*b*), i.e., in the open direction from the closed position, the latch 3 is slid together with the slider 2 through the engagement protrusion 61 engaged with the restraint portion 36 while remaining in the retraction position, and due to the sliding, the urging force is accumulated in the urging device S. When the sliding door 50 is further moved in the open direction, as shown in FIG. 13(*a*), in the latch 3, the convex portions 33 and 34 reach the corresponding locking groove 14*b* from the corresponding straight groove 14*a*. Then, while the latch 3 is rotating clockwise as the supporting point of the axis portion 27 by the stress when the engagement protrusion 61 presses the claw portion 35 and comes out of the restraint portion 36, the convex portions 33 and 34 engage with the corresponding locking groove 14*b*, so that the latch 3 is switched to the standby position. The urging force accumulated in the urging device S is maintained as long as the latch 3 is in the standby position.

(5) By applying the movement assist device having the above-mentioned structure to the sliding door 50, compared to the conventional sliding door with the door neck, the sliding door 50 is manufactured in the state wherein the end face 51 on the door neck side is formed in the flat face, and the retraction tool 5 and the receiving member 8 are placed along the flat face thereof. Accordingly, the door neck can be formed in the sliding door 50 so as to be capable of reducing the man-hours required for manufacturing the sliding door 50. Moreover, in the movement assist device, the light-blocking member 7 is provided between the case 1 of the retraction tool 5 and the receiving member 8 so as to be capable of preventing the light inside the room from leaking to the outside.

Incidentally, a technical scope of the present invention is not limited to each embodiment described hereinabove provided that it includes the above-mentioned respective structural elements, and the details can be developed or modified further based on each embodiment.

The present application is based on Japanese Patent Application No. 2010-124143 filed on May 31, 2010, and contents thereof are incorporated herein as references.

EXPLANATION OF SYMBOLS

1 . . . a case
1*a* . . . a leading portion
1*b* . . . a guide portion
10 . . . an upper face
11*a* . . . an urging-device placement portion
11*b* . . . a braking-device placement portion
12 . . . lateral faces
12*a* . . . locking portions
12*d* . . . a control portion
13*a* and 13*b* . . . attachment holes
14 . . . a guide portion
14*a* . . . a straight groove
14*b* . . . a locking groove
15 . . . a cover

16 . . . a leading portion
17 . . . an attachment portion
17*a* . . . a hole
18 . . . a concave portion
19 . . . lateral faces
19*a* . . . engagement portions
2 . . . a slider
20 . . . an upper face
21 . . . a lower face
22 . . . a back face
23 and 24 . . . convex portions
25 . . . an insertion hole
26*a* and 26*b* . . . through-bores
27 . . . an axis portion
3 . . . a latch
30 . . . an upper face
31 . . . a lower face
32 . . . a back face
33 and 34 . . . convex portions
35 . . . a claw portion
36 . . . a restraint portion
37 . . . a pivotal support hole
38 . . . a locking portion
39 . . . a latch-holding hole
4 . . . a braking device
40 . . . a cylinder
41 . . . a piston rod
42 and 43 . . . neck-like locking grooves
5 . . . a retraction tool
50 . . . a sliding door (corresponds to a moving body)
50*a* and 50*b* . . . end faces
51 . . . an upper end face
6 and 6A . . . strikers
60 . . . an attachment portion
61 . . . an engagement protrusion
62*a*, 62*b*, and 62*c* . . . attachment holes
63 and 64 . . . standing walls
65 . . . a fitting groove
66 . . . a receiving portion
67 . . . an end face
68 . . . an attachment hole
69 . . . a gap-absorbing spacer
7 . . . a light-blocking member
70 . . . a horizontal portion
71 . . . a light-blocking portion
71*a* . . . an end portion
72 . . . leg portions
73 . . . an elastic abutting portion
8 . . . a receiving member
80 . . . an attachment hole
81 . . . lateral faces
82 . . . an upper face
83 . . . a lower face
84 . . . a front end face
85 . . . a fitting groove
85*a* . . . a horizontal groove
85*b* . . . a vertical groove
86 . . . a seat portion
87 . . . a locking vertical wall
88 . . . a back end face
9 . . . a main body frame (corresponds to a fixed body)
9*a* . . . transverse grooves
90 . . . a crossbar (a transverse board)
91 . . . vertical boards
92 . . . a frame member
S . . . an urging device
S1 and S2 . . . locking portions on both sides

What is claimed is:

1. A movement assist device, comprising:

a retraction tool including a case, a latch housed in the case and switched between a standby position which is locked inside the case to be incapable of sliding, and a retraction position which releases the locking so to be capable of sliding, and an urging device housed in the case and having an end fixed to the latch; and a striker switching the latch from the standby position to the retraction position, or switching the latch from the retraction position to the standby position when the striker engages the latch, wherein either one of the retraction tool or the striker is provided in either one of a fixed body, or a moving body movably disposed in the fixed body, and also wherein the other of the retraction tool or the striker is provided in the other of the fixed body or the moving body, and when the latch is switched from the standby position to the retraction position, the moving body can move by an urging force of the urging device, and wherein the case includes a striker leading portion which is notched and has a width thinner than a rest of the case, from one end of the case to a middle of the case in a longitudinal direction of the case, and also one portion of the latch is exposed and disposed in the leading portion from an inside of the case.

2. A movement assist device according to claim 1, wherein the case includes an installation surface disposed in a corresponding attachment portion of the fixed body or the moving body, and the leading portion is formed in a portion where the installation surface is not present.

3. A movement assist device according to claim 1, wherein the one end of the case has a narrow end part, and the case further includes a guide portion inclining toward the leading portion.

* * * * *